US009076370B2

(12) United States Patent
Tanaka

(10) Patent No.: US 9,076,370 B2
(45) Date of Patent: Jul. 7, 2015

(54) SCANNING SIGNAL LINE DRIVE CIRCUIT, DISPLAY DEVICE HAVING THE SAME, AND DRIVE METHOD FOR SCANNING SIGNAL LINE

(75) Inventor: Shinya Tanaka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 166 days.

(21) Appl. No.: 14/111,269

(22) PCT Filed: May 11, 2012

(86) PCT No.: PCT/JP2012/062098

§ 371 (c)(1),
(2), (4) Date: Oct. 11, 2013

(87) PCT Pub. No.: WO2012/157545

PCT Pub. Date: Nov. 22, 2012

(65) Prior Publication Data

US 2014/0035891 A1 Feb. 6, 2014

(30) Foreign Application Priority Data

May 18, 2011 (JP) ..... 2011-111115

(51) Int. Cl.

| | |
|---|---|
| ***G09G 3/36*** | (2006.01) |
| ***G09G 3/02*** | (2006.01) |
| ***G09G 3/20*** | (2006.01) |

(52) U.S. Cl.

CPC .. *G09G 3/02* (2013.01); *G09G 3/20* (2013.01); *G09G 3/36* (2013.01); *G09G 3/3674* (2013.01); *G09G 3/3677* (2013.01)

(58) Field of Classification Search

CPC ..... G09G 3/3677; G09G 2310/0286
USPC ..... 345/100, 204, 87
See application file for complete search history.

(56) References Cited

U.S. PATENT DOCUMENTS

| | | | | |
|---|---|---|---|---|
| 2006/0017686 | A1* | 1/2006 | Park | 345/100 |
| 2006/0164376 | A1 | 7/2006 | Moon | |
| 2006/0221042 | A1* | 10/2006 | Cho et al. | 345/100 |

FOREIGN PATENT DOCUMENTS

| | | | |
|---|---|---|---|
| JP | 2004-103226 | A | 4/2004 |

OTHER PUBLICATIONS

Official Communication issued in International Patent Application No. PCT/JP2012/062098, mailed on Aug. 14, 2012.

*Primary Examiner* — Koosha Sharifi-Tafreshi
(74) *Attorney, Agent, or Firm* — Keating & Bennett, LLP

(57) ABSTRACT

The present invention is directed to suppress dullness of a scanning signal in a scanning signal line drive circuit. A bistable circuit is provided with an input terminal (43) for receiving a first clock signal (CK), an input terminal (48) for receiving a control signal (CT), an input terminal (49) for receiving a level down signal (LD), an output terminal (51), a thin film transistor (T2), and a thin film transistor (TA). The thin film transistor (T2) has a gate terminal connected to a first node (N1), a drain terminal connected to the input terminal (43), and a source terminal connected to the output terminal (51). The thin film transistor (TA) has a gate terminal connected to the input terminal (48), a drain terminal connected to the first node (N1), and a source terminal connected to the input terminal (49). The potential of the control signal (CT) becomes the high level in a control period as a period except for the first one horizontal scanning period in a vertical blanking period. The level down signal (LD) is a potential lower than DC power supply potential (Vss).

15 Claims, 17 Drawing Sheets

SCANNING SIGNAL LINE DRIVE CIRCUIT, DISPLAY DEVICE HAVING THE SAME, AND DRIVE METHOD FOR SCANNING SIGNAL LINE

TECHNICAL FIELD

The present invention relates to a scanning signal line drive circuit, a display device having the same, and a drive method for a scanning signal line and, more particularly, to a scanning signal line drive circuit suitable for monolithic fabrication, a display device having the same, and a drive method for a scanning signal line by the scanning signal line drive circuit.

BACKGROUND ART

Conventionally, a gate driver (a scanning signal line drive circuit) for driving gate lines (scanning signal lines) of a liquid crystal display device is often mounted as an IC (Integrated Circuit) chip in a peripheral portion of a substrate serving as a component of a liquid crystal panel. In recent years, however, formation of a gate driver directly formed on a substrate is gradually increasing. Such a gate driver is called a "monolithic gate driver" or the like.

In a liquid crystal display device having a monolithic gate driver, a thin film transistor using amorphous silicon (a-Si) (hereinbelow, called an "a-Si TFT") is employed conventionally as a drive element. However, in recent years, a thin film transistor using microcrystalline silicon (μc-Si) (hereinbelow, called a "μc-Si TFT") or a thin film transistor using an oxide semiconductor (for example, IGZO) is being adopted as a drive element. Hereinafter, a thin film transistor using IGZO will be called an "IGZO TFT". The μc-Si TFT and IGZO TFT have mobility higher than that of a-Si TFT. Consequently, by adopting μc-Si TFT or IGZO TFT as a drive element, reduction in a picture-frame area of the liquid crystal display device and higher definition can be realized.

A display unit in an active matrix-type liquid crystal display device includes a plurality of source lines (video signal lines), a plurality of gate lines, and a plurality of pixel formation portions provided in correspondence with intersecting points of the plurality of source lines and the plurality of gate lines. The pixel formation portions are arranged in a matrix, thereby constituting a pixel array. Each of the pixel formation portions includes a thin film transistor (switching element) having a gate terminal connected to a gate line passing a corresponding intersecting point and a source terminal connected to a source line passing the intersecting point, a pixel capacitance for holding pixel voltage, and so on. The active matrix-type liquid crystal display device is also provided with the above-described gate driver and a source driver (video signal line drive circuit) for driving source lines.

A video signal indicative of a pixel voltage value is transmitted through a source line. However, video signals indicative of pixel voltage values for a plurality of rows cannot be transmitted by each source line at once (simultaneously). Due to this, the video signals are sequentially written (charged) line by line to the pixel capacitances in the above-described pixel formation portions arranged in a matrix. Consequently, the gate driver is configured by a shift register including a plurality of stages so that the plurality of gate lines are sequentially selected by predetermined periods. Each of the stages of the shift register is a bistable circuit which is in either one of two states (a first state and a second state) at each time point and outputs a signal indicative of the state (hereinbelow, called a "state signal") as a scanning signal. By outputting active scanning signals sequentially from a plurality of bistable circuits in the shift register, the video signals are sequentially written to the pixel capacitances line by line as described above.

Such a bistable circuit is configured by an element such as the above-described a-Si TFT, μc-Si TFT, or IGZO TFT. It is, however, generally known that a threshold value shifts with operation time as to those transistors. FIG. 16 is an Id-Vgs characteristic diagram of an n-channel-type transistor. It should be noted that Id expresses a drain current, and Vgs expresses a gate-source voltage. The solid line in the diagram expresses the characteristic before threshold shift, and the broken line expresses the characteristic after threshold shift. As illustrated in FIG. 16, the threshold shifts to the positive direction with the operation time. Particularly, when threshold shift occurs in a transistor regulating output of a scanning signal, the scanning signal becomes dull as illustrated in FIG. 17. It should be noted that the solid line in the diagram expresses a scanning signal before the threshold shift, and the broken line expresses a scanning signal after the threshold shift.

In relation to the present invention, Patent Document 1 discloses a shift register in which, as illustrated in FIG. 18, each stage is configured by a pull-up unit 171, a pull-down unit 172, a pull-up driving unit 173, a first pull-down driving unit 174, and a second pull-down driving unit 175. The pull-up unit 171 is configured by a transistor M1. The pull-down unit 172 is configured by a transistor M2. The pull-up driving unit 173 is configured by a capacitor C and transistors M3 to M5. The first pull-down driving unit 174 is configured by transistors M6 and M7 as a first inverter. The second pull-down driving unit 175 is configured by transistors M8 and M9 as a second inverter for controlling the first inverter. An output of the second pull-down driving unit 175 is supplied to a gate terminal of the transistor M6 connected to a VON side in the first pull-down driving unit 174. With such a configuration, the difference in the channel width between the transistors M6 and M7 in the first pull-down driving unit 174 can be minimized, so that the flow of an excessive current to the transistor M6 can be prevented. Consequently, deterioration in the transistor M6 can be prevented.

PRIOR ART DOCUMENT

Patent Document

[Patent Document 1] Japanese Patent Application Laid-Open No. 2004-103226

SUMMARY OF THE INVENTION

Problem to be Solved by the Invention

However, in the configuration described in Patent Document 1, dullness of a scanning signal caused by threshold shift of a transistor cannot be suppressed.

An object of the present invention is, therefore, to provide a scanning signal line drive circuit suppressing dullness of a scanning signal, a display device having the same, and a drive method for a scanning signal line for suppressing dullness of a scanning signal.

Means for Solving the Problems

A first aspect of the present invention is directed to a scanning signal line drive circuit for periodically driving a plurality of scanning signal lines, the scanning signal line drive circuit comprising:

a shift register including a plurality of bistable circuits which are cascade-connected to one another and sequentially making output signals of the plurality of bistable circuits active based on clock signals which are supplied from the outside and periodically repeats an on level and an off level, wherein each of the bistable circuits comprises:

a drive unit having a first node and changing a potential of the first node based on a set signal; and an output unit connected to the first node and, when the potential of the first node is at the on level, outputting one of the output signals which is active based on the clock signals, the set signal in the bistable circuit in a front stage is a start pulse signal which becomes an on level at a scanning start timing, the set signal in the bistable circuit in a stage other than the front stage is an output signal of the bistable circuit of a preceding stage, the output unit has an output control switching element having a control terminal connected to the first node, a conduction terminal to which one of the clock signals is supplied, and another conduction terminal connected to an output node for outputting one of the output signals, and the drive unit has a first node level down switching element having a control terminal to which a control signal whose potential becomes the on level in a control period as a predetermined period in a vertical blanking period in which all of the output signals of the plurality of bistable circuits are inactive is supplied, a conduction terminal connected to the first node, and another conduction terminal to which a level down signal which becomes a level down potential as a potential lower than the off level at least in the control period is supplied.

According to a second aspect of the present invention, in the first aspect of the present invention, the clock signals include a first clock signal and a second clock signal whose phases are deviated from each other only by one horizontal scanning period, the first clock signal is supplied to the conduction terminal of the output control switching element, and the drive unit further comprises:

a second node;

a second-node-on-time first node turn off switching element having a control terminal connected to the second node, a conduction terminal connected to the first node, and another conduction terminal to which a potential at the off level is supplied;

a second node variation switching element for changing a potential of the second node based on the second clock signal; and a first-clock-signal-on-time second node turn off switching element having a control terminal to which the first clock signal is supplied, a conduction terminal connected to the second node, and another conduction terminal to which a potential at the off level is supplied.

According to a third aspect of the present invention, in the second aspect of the present invention, supply of the first clock signal and the second clock signal to the plurality of bistable circuits is stopped in the control period.

According to a fourth aspect of the present invention, in the third aspect of the present invention, the drive unit further comprises a control period second node turn off switching element having a control terminal to which the control signal is supplied, a conduction terminal connected to the second node, and another conduction terminal to which a potential at the off level is supplied.

According to a fifth aspect of the present invention, in the second aspect of the present invention, the drive unit further comprises a first clock level down switching element having a control terminal to which the control signal is supplied, a conduction terminal connected to the control terminal of the first-clock-signal-on-time second node turn off switching element, and another conduction terminal to which the level down signal is supplied.

According to a sixth aspect of the present invention, in the fifth aspect of the present invention, in the control period, supply of the first clock signal to the plurality of bistable circuits is stopped, and a terminal of each bistable circuit for receiving the first clock signal enters a high impedance state.

According to a seventh aspect of the present invention, in the second aspect of the present invention, the drive unit further comprises a second clock level down switching element having a control terminal to which the control signal is supplied, a conduction terminal connected to the control terminal and the conduction terminal of the second node variation switching element, and another conduction terminal to which the level down signal is supplied.

According to an eighth aspect of the present invention, in the seventh aspect of the present invention, in the control period, supply of the second clock signal to the plurality of bistable circuits is stopped, and a terminal of each bistable circuit for receiving the second clock signal enters a high impedance state.

According to a ninth aspect of the present invention, in the first aspect of the present invention, the drive unit further comprises a first node turn on switching element which changes the potential of the first node toward the on level based on the set signal.

According to a tenth aspect of the present invention, in the first aspect of the present invention, the drive unit further comprises a set-time second node turn off switching element having a control terminal connected to the first node, a conduction terminal connected to the second node, and another conduction terminal to which a potential at the off level is supplied.

According to an eleventh aspect of the present invention, in the first aspect of the present invention, the output unit further comprises a capacitive element having one end connected to the control terminal of the output control switching element and another end connected to the output node.

According to a twelfth aspect of the present invention, in the first aspect of the present invention, the drive unit further comprises a reset-time first node turn off switching element having a control terminal to which a reset signal as an output signal of the bistable circuit at a post stage of the bistable circuit having the drive unit is supplied, a conduction terminal connected to the first node, and another conduction terminal to which a potential at the off level is supplied, and the output unit further comprises an output node turn off switching element having a control terminal to which the reset signal is supplied, a conduction terminal connected to the output node, and another conduction terminal to which a potential at the off level is supplied.

A thirteenth aspect of the present invention is directed to a display device comprising:

a display unit in which a plurality of scanning signal lines are arranged;

a scanning signal line drive circuit for periodically driving the plurality of scanning signal lines; and a display control circuit supplying clock signals which periodically repeat an on level and an off level, to the scanning signal line drive circuit, wherein the scanning signal line drive circuit includes a shift register having a plurality of bistable circuits which are cascade-connected to one another and sequentially making output signals of the plurality of bistable circuits active based on the clock signals, each of the bistable circuits comprises:

a drive unit having a first node and changing a potential of the first node based on a set signal; and an output unit connected to the first node and, when the potential of the first node is at the on level, outputting one of the output signals which is active based on the clock signals, the set signal in the bistable circuit in a front stage is a start pulse signal which becomes an on level at a start timing of each of vertical scanning periods, the set signal in the bistable circuit in a stage other than the front stage is an output signal of the bistable circuit of a preceding stage, the output unit has an output control switching element having a control terminal connected to the first node, a conduction terminal to which one of the clock signals is supplied, and another conduction terminal connected to an output node for outputting one of the output signals, and the drive unit has a first node level down switching element having a control terminal to which a control signal whose potential becomes the on level in a control period as a predetermined period in a vertical blanking period in which all of the output signals of the plurality of bistable circuits are inactive is supplied, a conduction terminal connected to the first node, and another conduction terminal to which a level down signal which becomes a level down potential as a potential lower than the off level at least in the control period is supplied.

According to a fourteenth aspect of the present invention, in the thirteenth aspect of the present invention, the display unit and the scanning signal line drive circuit are integrally formed.

A fifteenth aspect of the present invention is directed to a drive method for a plurality of scanning signal lines by a scanning signal line drive circuit comprising a shift register including a plurality of bistable circuits which are cascade-connected to one another and sequentially making output signals of the plurality of bistable circuits active based on clock signals which are supplied from the outside and periodically repeat an on level and an off level, the drive method comprising the steps of:

changing a potential of a first node of each bistable circuit based on a set signal received by each bistable circuit; and outputting one of the output signals which is active based on one of the clock signals when the potential of the first node is at the on level, wherein each bistable circuit has an output control switching element having a control terminal connected to the first node, a conduction terminal to which one of the clock signals is supplied, and another conduction terminal connected to an output node for outputting one of the output signals, the set signal received by the bistable circuit in a front stage is a start pulse signal which becomes an on level at a scanning start timing, the set signal received by the bistable circuit in a stage other than the front stage is an output signal of the bistable circuit of a preceding stage, and the step of changing the potential of the first node includes a step of setting the potential of the first node to a level down potential as a potential which is lower than the off level at least in a control period as a predetermined period in a vertical blanking period in which all of the output signals of the plurality of bistable circuits are inactive.

Effects of the Invention

According to the first aspect of the present invention, in the control period included in the vertical blanking period, the output control switching element is driven by a voltage lower than that in the conventional technique. Consequently, stress to the control terminal of the output control switching element is reduced as compared with the conventional technique. Thus, the threshold shift in the output control switching element is suppressed, so that dullness of a scanning signal as the output signal of the bistable circuit can be suppressed.

According to the second aspect of the present invention, in the case of controlling the potential of the first node by the potential of the second node, in a period other than a period for outputting an active output signal, the potential of the second node changes with fluctuation in the second clock signal having the phase opposite to that of the first clock signal. Consequently, in the period other than the period for outputting the active output signal, the potential fluctuation in the first node caused by the potential fluctuation in the first clock signal is suppressed. Therefore, stabilization of the circuit operation can be realized.

According to the third aspect of the present invention, in the control period included in the vertical blanking period, supply of the clock signal to the bistable circuit is stopped. Consequently, the switching element to be driven by a voltage lower than that in the conventional technique is more reliably driven by a voltage lower than that in the conventional technique.

According to the fourth aspect of the present invention, in the control period included in the vertical blanking period, the potential of the second node is reliably maintained at the off level. Consequently, the second-node-on-time first node turn-off switching element reliably enters an off state. Thus, since the output control switching element is reliably driven by a voltage lower than that in the conventional technique, stress to the control terminal of the output control switching element is reliably reduced. Therefore, threshold shift in the second-node-on-time first node turn off switching element is reliably suppressed, so that dullness of a scanning signal as the output signal of the bistable circuit can be reliably suppressed.

According to the fifth aspect of the present invention, the first-clock-signal-on-time second node turn off switching element is driven by a voltage lower than that in the conventional technique. Consequently, stress to the control terminal of the first-clock-signal-on-time second node turn off switching element is reduced as compared with the conventional technique. Thus, since the threshold shift in the first-clock-signal-on-time second node turn off switching element is suppressed, the second-node-on-time first node turn off switching element is controlled more accurately. Therefore, stabilization of the circuit operation can be achieved.

According to the sixth aspect of the present invention, in the control period included in the vertical blanking period, supply of the first clock signal to the plurality of bistable circuits is stopped, and a terminal in each bistable circuit for receiving the first clock signal enters a high impedance state. Consequently, the first-clock-signal-on-time second node turn off switching element is more reliably driven by a voltage lower than that in the conventional technique. Consequently, stress to the control terminal of the first-clock-signal-on-time second node turn off switching element is more reliably reduced as compared with the conventional technique. Therefore, threshold shift in the first-clock-signal-on-time second node turn off switching element is more reliably suppressed.

According to the seventh aspect of the present invention, the second node variation switching element is driven by a voltage lower than that in the conventional technique. Consequently, stress to the control terminal of the second node variation switching element is reduced as compared with the conventional technique. Therefore, threshold shift in the second node variation switching element is suppressed, so that the second-node-on-time first node turn off switching element is controlled more accurately. Therefore, stabilization of the circuit operation can be achieved.

According to the eighth aspect of the present invention, in the control period included in the vertical blanking period, supply of the second clock signal to the plurality of bistable circuits is stopped, and a terminal in each bistable circuit for receiving the second clock signal enters a high impedance state. Consequently, the second node variation switching element is more reliably driven by a voltage lower than that in the conventional technique. Accordingly, stress to the control terminal of the second node variation switching element is more reliably reduced as compared with the conventional technique. Therefore, threshold shift in the second node variation switching element is more reliably suppressed.

According to the ninth aspect of the present invention, the first node can be reliably set to the on level by using the first node turn on switching element.

According to the tenth aspect of the present invention, when the potential of the set signal becomes the on level, the potential of the second node becomes the off level. Consequently, the second-node-on-time first node turn off switching element enters an off state, so that the potential of the first node can be reliably set to the on level by the set signal.

According to the eleventh aspect of the present invention, the potential of the first node can be reliably held.

According to the twelfth aspect of the present invention, after an output signal of the bistable circuit becomes active, the potential of each of the first node and the output node can be reliably set to the off level.

According to the thirteenth aspect of the present invention, in the display device, effects similar to those of the first aspect of the present invention can be produced.

According to the fourteenth aspect of the present invention, the picture-frame area in the display device can be reduced.

According to the fifteenth aspect of the present invention, in the drive method for a scanning signal line, effects similar to those of the first aspect of the present invention can be produced.

MODES FOR CARRYING OUT THE INVENTION

Hereinafter, with reference to the appended drawings, embodiments of the present invention will be described. It should be noted that, in the following description, a gate terminal of a thin film transistor corresponds to a control terminal, a drain terminal corresponds to one of conduction terminals, and a source terminal corresponds to the other conduction terminal. In the description, it is assumed that all of thin film transistors provided in a bistable circuit are of the n-channel type.

1. First Embodiment

<1.1 Overall Configuration and Operation>

Figure 1:
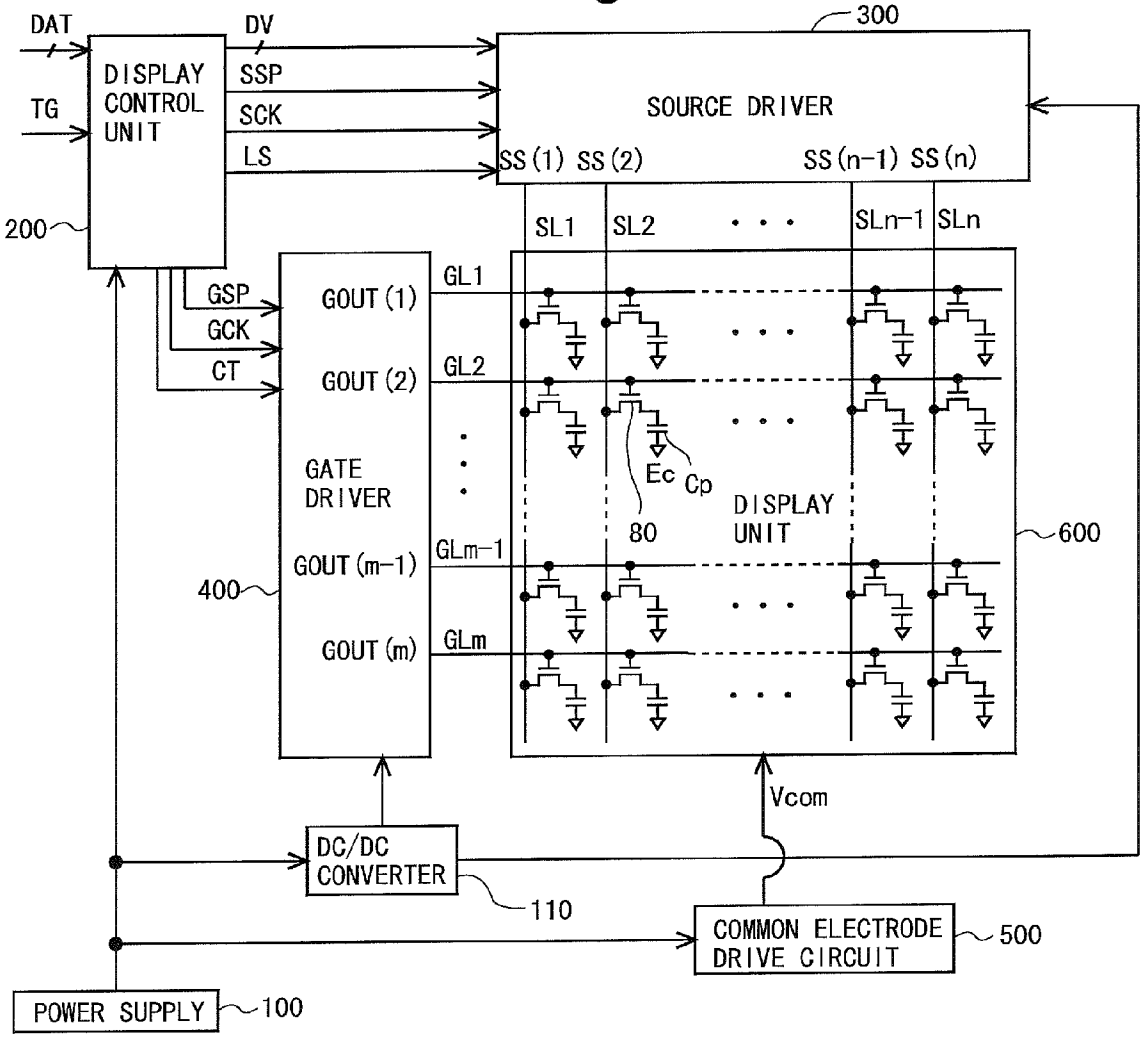
FIG. 1 is a block diagram illustrating an overall configuration of a liquid crystal display device according to a first embodiment of the present invention.

FIG. 1 is a block diagram illustrating an overall configuration of an active matrix-type liquid crystal display device according to a first embodiment of the present invention. As illustrated in FIG. 1, the liquid crystal display device includes a power supply 100, a DC/DC converter 110, a display control circuit 200, a source driver (a video signal line drive circuit) 300, a gate driver (a scanning signal line drive circuit) 400, a common electrode drive circuit 500, and a display unit 600. It should be noted that the gate driver 400 is formed on a display panel including the display unit 600 by using amorphous silicon, polycrystal silicon, microcrystal silicon, oxide semiconductor (for example, IGZO), or the like. That is, in the present embodiment, the gate driver 400 and the display unit 600 are formed on the same substrate (the array substrate which is one of two substrates constituting the liquid crystal panel). Consequently, the picture-frame area of the liquid crystal display device can be reduced.

In the display unit 600, a pixel circuit is formed, which includes n source lines (video signal lines) SL1 to SLn, m gate lines (scanning signal lines) GL1 to GLm, and m×n pixel formation portions provided in correspondence with intersecting points of the source lines SL1 to SLn and the gate lines. The plurality of pixel formation portions are arranged in a matrix, thereby constituting a pixel array. Each of the pixel formation portions includes a thin film transistor 80 which is a switching element whose gate terminal is connected to a gate line passing a corresponding intersecting point and whose source terminal is connected to a source line passing the intersecting point, a pixel electrode connected to a drain terminal of the thin film transistor 80, a common electrode Ec which is an opposed electrode provided commonly for the plurality of pixel formation portions, and a liquid crystal layer commonly provided for the plurality of pixel formation portions and sandwiched between the pixel electrode and the common electrode Ec. By a liquid crystal capacitance formed by the pixel electrode and the common electrode Ec, a pixel capacitance Cp is formed. It should be noted that, although an auxiliary capacitance is usually provided in parallel to the liquid crystal capacitance in order to reliably hold a voltage in the pixel capacitance Cp, the description and depiction of the auxiliary capacitance are omitted since the auxiliary capacitance is not directly related to the present invention.

The power supply 100 supplies predetermined power supply voltage to the DC/DC converter 110, the display control circuit 200, and the common electrode drive circuit 500. The DC/DC converter 110 generates predetermined DC voltage for operating the source driver 300 and the gate driver 400 from the power supply voltage and supplies the generated voltage to the source driver 300 and the gate driver 400. The common electrode drive circuit 500 supplies a predetermined potential Vcom to the common electrode Ec.

The display control circuit 200 receives an image signal DAT and a group of timing signals TG such as a horizontal synchronization signal and a vertical synchronization signal which are sent from the outside, and outputs a digital video signal DV, and a source start pulse signal SSP, a source clock signal SCK, a latch strobe signal LS, a gate start pulse signal GSP, a gate clock signal GCK, and a control signal CT for controlling image display in the display unit 600. The potential on the high level side of the gate clock signal GCK is Vdd, and the potential on the low level side is Vss.

The source driver 300 receives the digital video signal DV, the source start pulse signal SSP, the source clock signal SCK, and the latch strobe signal LS which are output from the display control circuit 200 and applies video signals SS(1) to SS(n) to the source lines SL1 to SLn, respectively.

Based on the gate start pulse signal GSP, the gate clock signal GCK, and the control signal CT which are output from the display control circuit 200, the gate driver 400 repeats application of active scanning signals GOUT(1) to GOUT(m) to the respective gate lines GL1 to GLm in cycles of one vertical scanning period. It should be noted that detailed description of the gate driver 400 will be given later.

In the above-described manner, the video signals SS(1) to SS(n) are applied to the source lines SL1 to SLn, respectively, and the scanning signals GOUT(1) to GOUT(m) are applied to the gate lines GL1 to GLm, respectively, thereby displaying an image based on the image signal DAT sent from the outside on the display unit 600.

<1.2 Configuration and Operation of Gate Driver>

Figure 2:
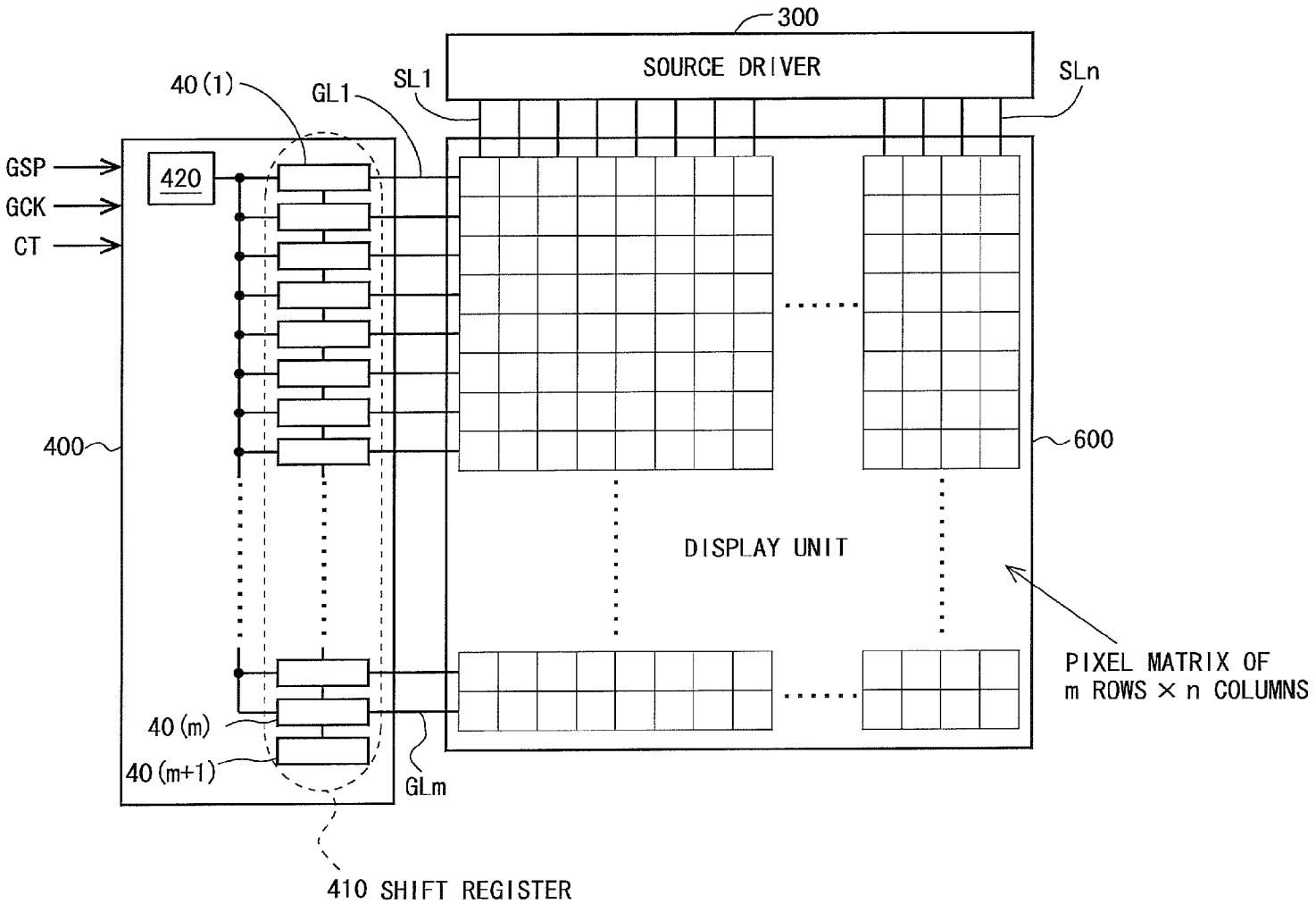
FIG. 2 is a block diagram for explaining a configuration of a gate driver in the first embodiment.

FIG. 2 is a block diagram for explaining the configuration of the gate driver 400 in the present embodiment. As illustrated in FIG. 2, the gate driver 400 is configured by a clock control circuit 420 and a shift register 410 including m (stages) of bistable circuits 40(1) to 40(*m*) and one (stage) of a dummy bistable circuit 40(*m*+1) (hereinbelow, called a "dummy stage"). The clock control circuit 420 is a circuit for controlling supply of the gate clock signal GCK to the shift register 410. That is, the clock control circuit 420 receives the gate clock signal GCK and the control signal CT, and supplies, to the shift register 410, a gate clock signal GCKc (hereinbelow, called a "post-control gate clock signal") which is a signal obtained by stopping the gate clock signal GCK for a part of a period. The gate clock signal GCK includes a clock signal GCK1 (hereinbelow, called a "first gate clock signal") and a clock signal GCK2 (hereinbelow, called a "second gate clock signal") which are two-phase clock signals. The phases of the first gate clock signal GCK1 and the second gate clock signal GCK2 are deviated from each other only by one horizontal scanning period, and both of the signals enter a high-level (Vdd potential) state only for one horizontal scanning period in two horizontal scanning periods. It should be noted that detailed description of the clock control circuit 420 will be given later.

In the display unit 600, the pixel matrix of m rows×n columns is formed as described above, and the bistable circuits are provided in the stages so as to have a one-to-one correspondence with the rows of the pixel matrix. The bistable circuit is in either one of two states (a first state and a second state) at each time point and outputs a signal indicative of the state (hereinbelow, called a "state signal"). In the present embodiment, when the bistable circuit is in the first state, a high-level (on-level) state signal is output from the bistable circuit. When the bistable circuit is in the second state, a low-level (off-level) state signal is output from the bistable circuit. In the following, a period in which the high-level state signal is output from a bistable circuit and a high-level scanning signal is applied to a gate line corresponding to the bistable circuit will be called a "selection period".

Figure 3:
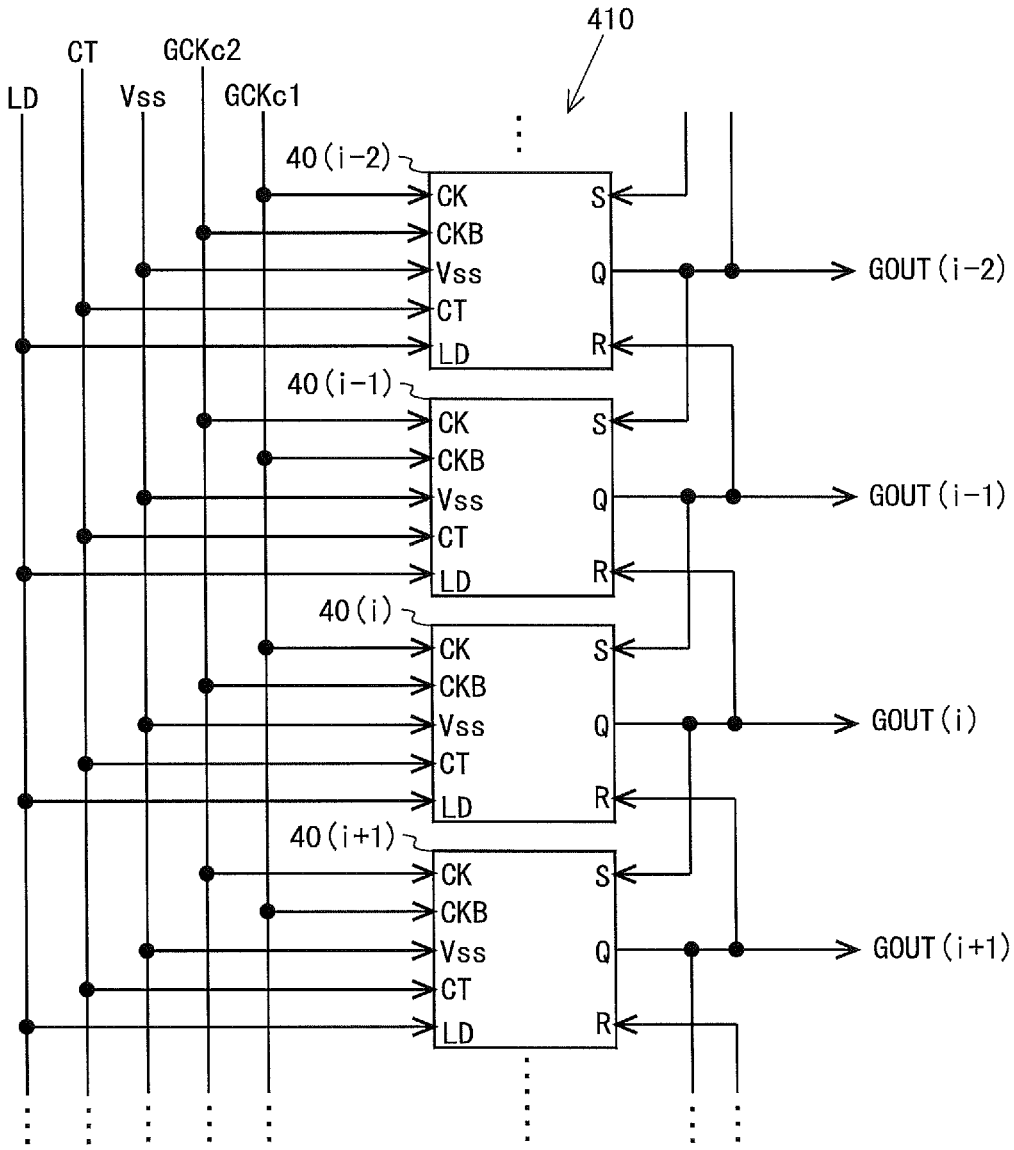
FIG. 3 is a block diagram illustrating a configuration of a shift register in the first embodiment.
Figure 4:
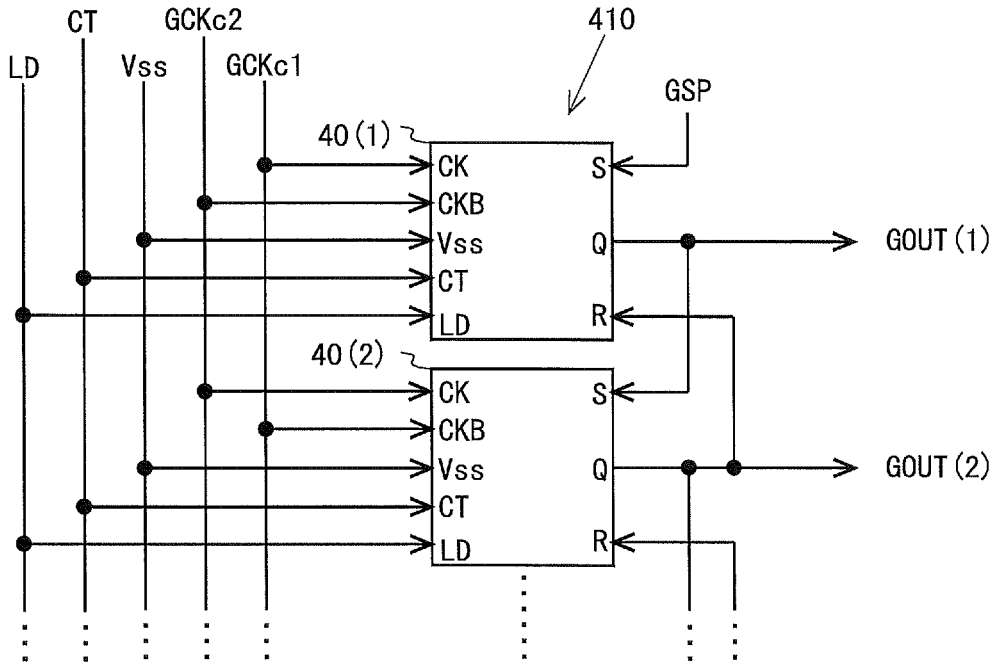
FIG. 4 is a block diagram illustrating a configuration of a front stage side of the shift register in the first embodiment.
Figure 5:
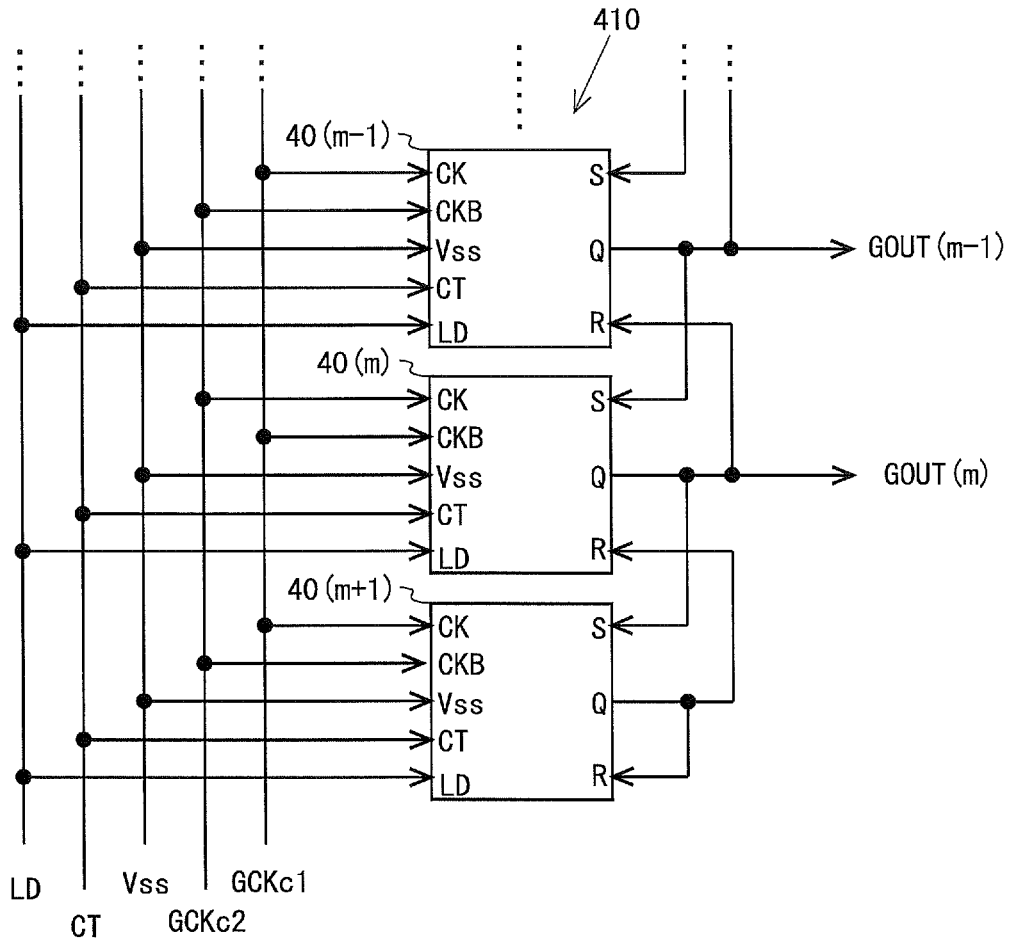
FIG. 5 is a block diagram illustrating a configuration of a last stage side of the shift register in the first embodiment.

FIG. 3 is a block diagram illustrating the configuration of the shift register 410 in the present embodiment except for the front and last stages. FIG. 4 is a block diagram illustrating the configuration of a front stage side of the shift register 410 in the present embodiment. FIG. 5 is a block diagram illustrating the configuration of a last stage side of the shift register 410 in the present embodiment. It should be noted that, in the following description, there is a case that a bistable circuit of the x-th stage (x=1 to m+1) will be simply called an "x-th stage". As described above, the shift register 410 includes the m bistable circuits 40(1) to 40(*m*) and one dummy bistable circuit 40(*m*+1). FIG. 3 illustrates the (i−2)th stage 40(*i*−2) to the (i+1)th stage 40 (i+1), FIG. 4 illustrates the first stage 40(1) and the second stage 40(2), and FIG. 5 illustrates the (m−1) th stage 40(*m*−1), the m-th stage 40(*m*), and the dummy stage 40(*m*+1).

Each bistable circuit is provided with an input terminal for receiving the clock signal CK (hereinbelow, called a "first clock signal"), an input terminal for receiving the clock signal CKB (hereinbelow, called a "second clock signal"), an input terminal for receiving the low-level DC power supply potential Vss (the magnitude of the potential will be also called a "Vss potential"), an input terminal for receiving the set signal S, an input terminal for receiving the reset signal R, an input terminal for receiving the control signal CT, an input terminal for receiving a level-down signal LD, and an output terminal for outputting the state signal Q.

Figure 6:
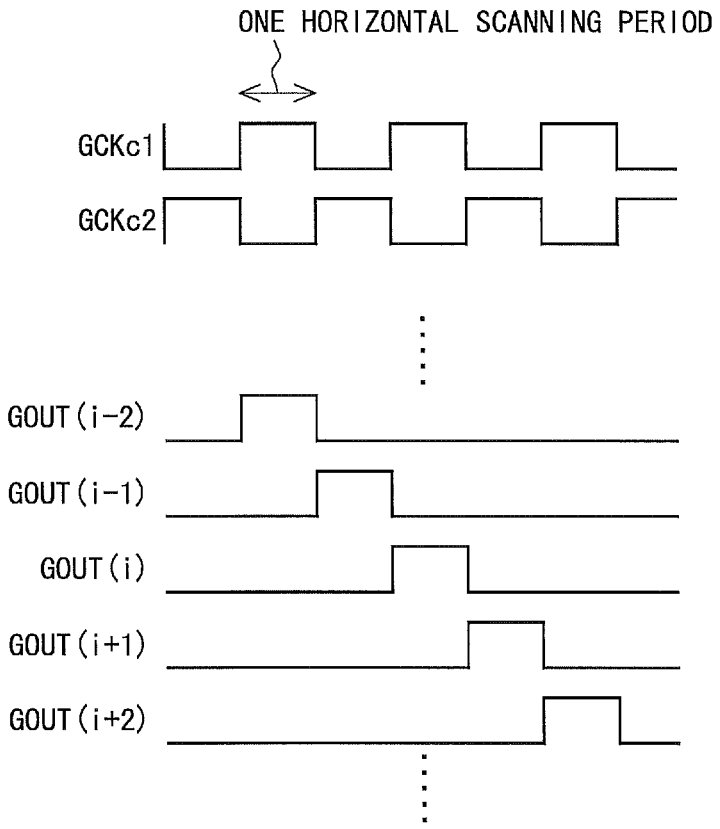
FIG. 6 is a signal waveform diagram for explaining the operation of the gate driver in the first embodiment.

To the shift register 410, as the post-control gate clock signal GCKc, a clock signal GCKc1 (hereinbelow, called a "post-control first gate clock signal") and a clock signal GCKc2 (hereinbelow, called a "post-control second gate clock signal") which are two-phase clock signals are supplied. As illustrated in FIG. 6, the phases of the post-control first gate clock signal GCKc1 and the post-control second gate clock signal GCKc2 are deviated from each other only by one horizontal scanning period, and both of the signals enter the high-level (Vdd potential) state only for one horizontal scanning period in two horizontal scanning periods (except for a vertical blanking period which will be described later).

Signals supplied to the input terminals of each stage (each bistable circuit) in the shift register 410 are as follows. It should be noted that it is assumed that i and m are even numbers. As illustrated in FIGS. 3 to 5, to odd-numbered stages, the post-control first gate clock signal GCKc1 is supplied as the first clock signal CK, and the post-control second gate clock signal GCKc2 is supplied as the second clock signal CKB. To even-numbered stages, the post-control first gate clock signal GCKc1 is supplied as the second clock signal CKB, and the post-control second gate clock signal GCKc2 is supplied as the first clock signal CK. To each stage, the low-level DC power supply voltage Vss, the control signal CT, and the level-down signal LD are commonly supplied.

To each stage, the state signal Q output from the preceding stage is supplied as the set signal S, and the state signal Q output from the next stage is supplied as the reset signal R. However, to the first stage (front stage) 40(1), a gate start pulse signal GSP is supplied as the set signal S. To the m-th stage (last stage) 40(*m*), a state signal output from the dummy stage 40(*m*+1) is supplied as the reset signal R. It should be noted that, to the dummy stage 40(*m*+1), the state signal Q output from the m-th stage (last stage) is supplied as the set signal S, and the state signal of the dummy stage 40(*m*+1) is supplied as the reset signal R. Consequently, a period in which the state signal Q of the dummy stage is active is shorter than a period in which the state signal Q of another stage is active.

In such a configuration, when the gate start pulse signal GSP as the set signal S is supplied to the first stage 40(1) of the shift register 410 (when the gate start pulse signal GSP becomes the high level at a scanning start timing), a pulse included in the gate start pulse signal GSP (this pulse is included in the state signal Q which is output from each stage) is sequentially transferred from the first stage 40(1) to the m-th stage 40(*m*) based on the post-control first gate clock signal GCKc1 and the post-control second gate clock signal GCKc2. According to the transfer of the pulse, the state signals Q output from the first stage 40(1) to the m-th stage 40(*m*) sequentially become the high level. The state signals Q output from the first stage 40(1) to the m-th stage 40(*m*) are supplied as scanning signals GOUT(1) to GOUT(m) to the gate lines GL1 to GLm, respectively. It should be noted that the state signals Q output from the first stage 40(1) to the m-th stage 40(*m*) may be supplied as the scanning signals GOUT (1) to GOUT(m) to the gate lines GL1 to GLm, respectively, after the voltages of them are increased by a level shifter. By the above, as illustrated in FIG. 6, scanning signals which become the high level (active) sequentially by one horizontal scanning period are supplied to the gate lines in the display unit 600. It should be noted that the detailed operation of the gate driver 400 will be described later.

<1.3 Configuration of Bistable Circuit>

Figure 7:
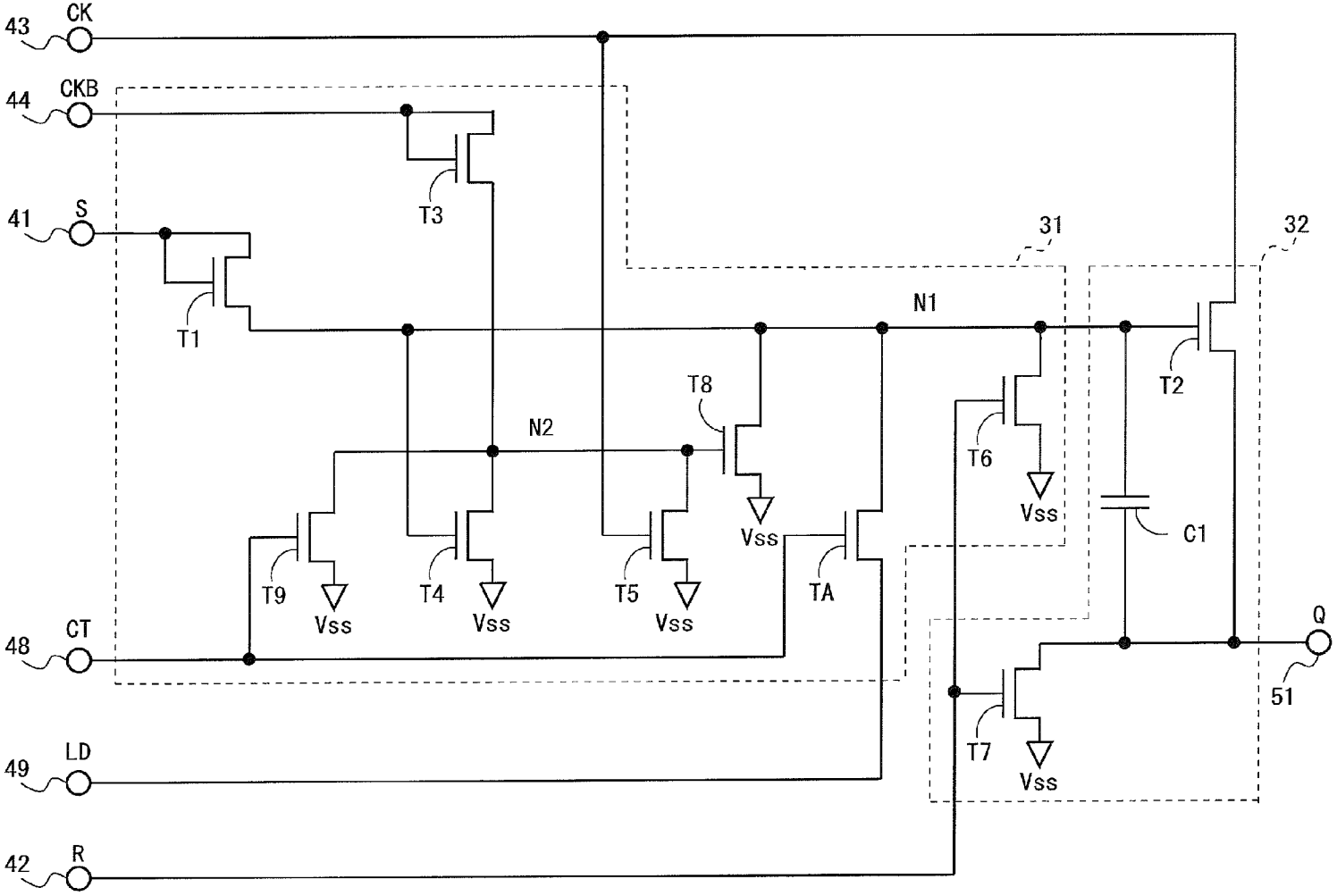
FIG. 7 is a circuit diagram illustrating a configuration of a bistable circuit in the first embodiment.

FIG. 7 is a circuit diagram illustrating a configuration of each of the bistable circuits in the present embodiment. As illustrated in FIG. 7, the bistable circuit is configured by a driving unit 31 and an output unit 32. The bistable circuit is provided with ten thin film transistors (switching elements) T1 to T9 and TA, one capacitor (capacitance element) C1, six input terminals 41 to 44, 48, and 49, an input terminal for low-level DC power supply potential Vss, and one output terminal (output node) 51. It should be noted that reference numeral 41 is designated to the input terminal receiving the set signal S, reference numeral 42 is designated to the input terminal receiving the reset signal R, reference numeral 43 is designated to the input terminal receiving the first clock signal CK, reference numeral 44 is designated to the input terminal receiving the second clock signal CKB, reference numeral 48 is designated to the input terminal receiving the control signal CT, and reference numeral 49 is designated to the input terminal receiving the level-down signal LD. Reference numeral 51 is designated to the output terminal outputting the state signal Q.

The driving unit 31 is configured by eight thin film transistors T1, T3 to T6, T8, T9 and TA, a first node which will be described later, and a second node which will be described later. The output unit 32 is configured by two thin film transistors T2 and T7 and one capacitor C1.

Next, the connection relations among components in the bistable circuit will be described. The source terminal of the thin film transistor T1, the gate terminal of the thin film transistor T2, the gate terminal of the thin film transistor T4, the drain terminal of the thin film transistor T6, the drain terminal of the thin film transistor T8, the drain terminal of the thin film transistor TA, and one end of the capacitor are connected to one another. In the following, for convenience, the connection points (wirings) at which they are connected to one another will be called "first node". The source terminal of the thin film transistor T3, the drain terminal of the thin film transistor T4, the drain terminal of the thin film transistor T5, the gate terminal of the thin film transistor T8, and the drain terminal of the thin film transistor T9 are connected to one another. In the following, the connection points (wirings) at which they are connected to one another will be called "second node". Reference numeral N1 is designated to the first node, and reference numeral N2 is designated to the second node. As described above, the first node N1 and the second node N2 are provided in the driving unit 31.

With respect to the thin film transistor T1, the gate terminal and the drain terminal are connected to the input terminal 41 (that is, diode-connected) and the source terminal is connected to the first node N1. With respect to the thin film transistor T2, the gate terminal is connected to the first node N1, the drain terminal is connected to the input terminal 43, and the source terminal is connected to the output terminal 51. With respect to the thin film transistor T3, the gate terminal and the drain terminal are connected to the input terminal 44 (that is, diode-connected) and the source terminal is connected to the second node N2. With respect to the thin film transistor T4, the gate terminal is connected to the first node N1, the drain terminal is connected to the second node N2, and the source terminal is connected to the input terminal for the DC power supply potential Vss. With respect to the thin film transistor T5, the gate terminal is connected to the input terminal 43, the drain terminal is connected to the second node N2, and the source terminal is connected to the input terminal for the DC power supply potential Vss. With respect to the thin film transistor T6, the gate terminal is connected to the input terminal 42, the drain terminal is connected to the first node N1, and the source terminal is connected to the input terminal for the DC power supply potential Vss. With respect to the thin film transistor T7, the gate terminal is connected to the input terminal 42, the drain terminal is connected to the output terminal 51, and the source terminal is connected to the input terminal for the DC power supply potential Vss. With respect to the thin film transistor T8, the gate terminal is connected to the second node N2, the drain terminal is connected to the first node N1, and the source terminal is connected to the input terminal for the DC power supply potential Vss. With respect to the thin film transistor T9, the gate terminal is connected to the input terminal 48, the drain terminal is connected to the second node N2, and the source terminal is connected to the input terminal for the DC power supply potential Vss. With respect to the thin film transistor TA, the gate terminal is connected to the input terminal 48, the drain terminal is connected to the first node N1, and the source terminal is connected to the input terminal 49. With respect to the capacitor C1, one end is connected to the first node, and the other end is connected to the output terminal 51.

Next, the function of each of the components in the bistable circuit will be described. The thin film transistor T1 changes the potential of the first node N1 toward the high level when the potential of the set signal S is at the high level. The thin film transistor T2 supplies the potential of the first clock signal CK to the output terminal 51 when the potential of the first node N1 is at the high level. The thin film transistor T3 changes the potential of the second node N2 toward the high level when the second clock signal CKB is at the high level. The thin film transistor T4 changes the potential of the second node N2 toward the Vss potential when the potential of the first node N1 is at the high level. The thin film transistor T5 changes the potential of the second node N2 toward the Vss potential when the potential of the first clock signal CK is at the high level. The thin film transistor T6 changes the potential of the first node N1 toward the Vss potential when the potential of the reset signal R is at the high level. The thin film transistor T7 changes the potential of the output terminal 51 toward the Vss potential when the potential of the reset signal R is at the high level. The thin film transistor T8 changes the potential of the first node N1 toward the Vss potential when the second node N2 is at the high level. The thin film transistor T9 changes the potential of the second node N2 toward the Vss potential when the potential of the control signal CT is at the high level. The thin film transistor TA changes the potential of the first node N1 toward the level down potential Vb (the magnitude of the potential will be also called a "Vb potential") which is lower than the Vss potential when the potential of the control signal CT is at the high level. The capacitor C1 functions as a compensation capacitance for maintaining the potential of the first node at the high level during the period in which the gate line connected to the bistable circuit is in a selection state.

In the present embodiment, a first node turn on switching element is realized by the thin film transistor T1, an output control switching element is realized by the thin film transistor T2, a second node variation switching element is realized by the thin film transistor T3, a set-time second node turn off switching element is realized by the thin film transistor T4, a first-clock-signal-on-time second node turn off switching element is realized by the thin film transistor T5, a reset-time first node turn off switching element is realized by the thin film transistor T6, an output node turn off switching element is realized by the thin film transistor T7, a second-node-on-time first node turnoff switching element is realized by the thin film transistor T8, a control period second node turn off switching element is realized by the thin film transistor T9, and a first node level down switching element is realized by the thin film transistor TA. A capacitance element is realized by the capacitor C1. The potential at the off level is realized by the Vss potential, and a level down potential as a potential which is lower than the off level is realized by the Vb potential.

<1.4 Operation of Bistable Circuit>

Figure 8:
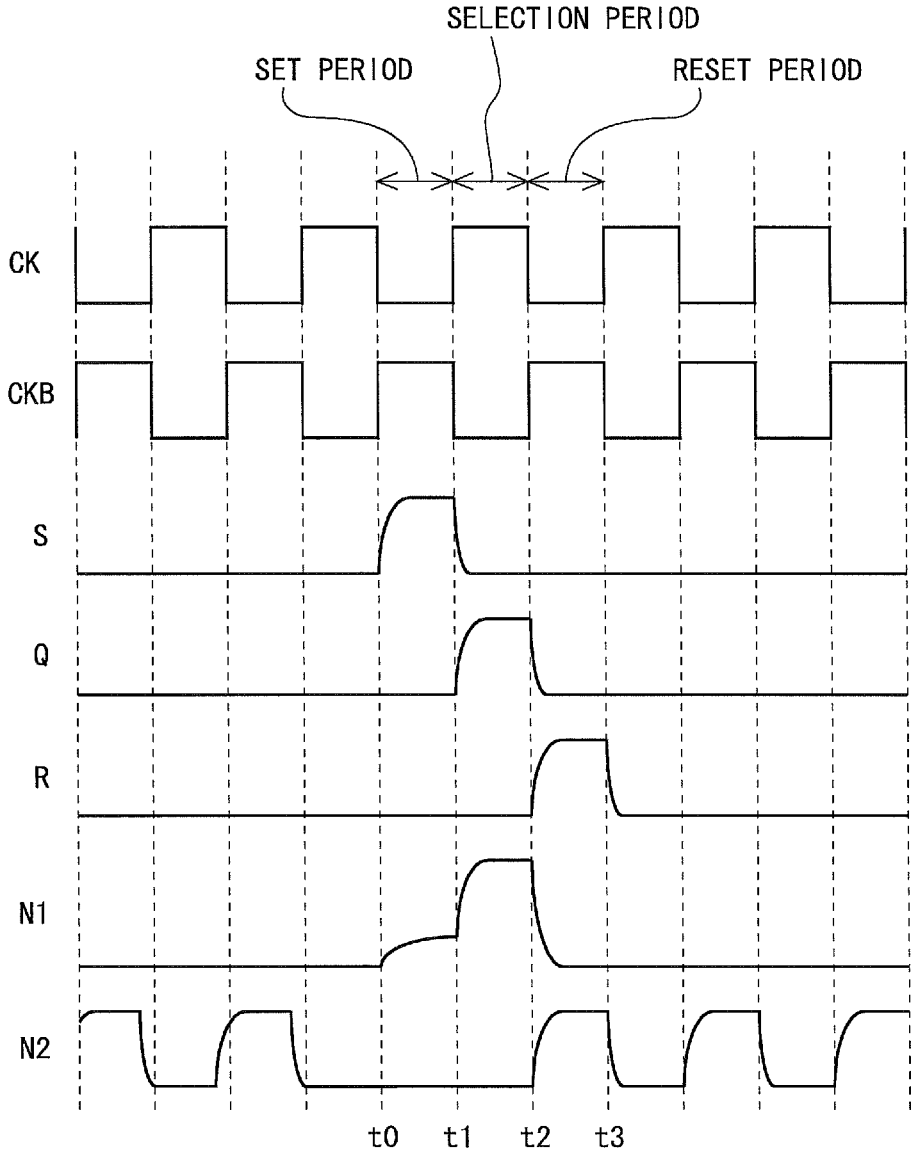
FIG. 8 is a signal waveform diagram for explaining the operation of the bistable circuit in a write period in the first embodiment.

FIG. 8 is a signal waveform diagram for explaining the operation of the bistable circuit 40(*i*) of the i-the stage in a write period in the present embodiment. It should be noted that, since the other bistable circuits operate similarly, their description is omitted. In FIG. 8, the period from the time point t1 to the time point t2 corresponds to a selection period. In the following, one horizontal scanning period just before the selection period will be called a "set period", and one horizontal scanning period immediately after the selection period will be called a "reset period". In one vertical scanning period, a period from the time point when the gate start pulse signal GSP rises (scanning start point) to the time point when the scanning signal GOUT(m+1) of the dummy stage rises will be called a "write period". In one vertical scanning period, a period from the time point when the scanning signal GOUT(m+1) of the dummy stage rises to the time point when the gate start pulse signal GSP rises in the following vertical scanning period will be called a "vertical blanking period". The vertical blanking period is a period in which all of output signals of the bistable circuits 40(1) to 40(*m*) except for the dummy stage 40(*m*+1) become inactive. The period other than the selection period, the set period, and the reset period, in the write period will be called a "normal operation period".

In the set period (at the time point t0), the set signal S changes from the low level to the high level. Since the thin film transistor T1 is diode-connected as illustrated in FIG. 7, when the set signal S becomes the high level, the thin film transistor T1 enters an on state, and the capacitor C1 is charged (in this case, precharged). Consequently, the potential of the first node N1 changes from the low level to the high level, and the thin film transistor T2 enters an on state. However, in the set period, since the potential of the first clock signal CK is at the low level, the potential of the state signal Q is maintained at the low level. At this time, the potential of the second clock signal CKB becomes the high level so that the thin film transistor T3 enters an on state and, the set signal S becomes the high level so that the thin film transistor T4 enters an on state. Consequently, the potential of the second node N2 does not become the high level. It should be noted that the on resistance of the thin film transistor T4 is desirably sufficiently lower than that of the thin film transistor T3.

In the selection period (at the time point t1), the set signal S changes from the high level to the low level. Consequently, the thin film transistor T1 enters an off state. At this time, the first node N1 enters a floating state. At the time point t1, the potential of the first clock signal CK changes from the low level to the high level. Since parasitic capacitance exists between the gate and drain of the thin film transistor T2, as the potential of the input terminal 43 rises, the potential of the first node N1 also rises (the first node N1 is bootstrapped). As a result, the thin film transistor T2 completely enters an on state, and the potential of the state signal Q rises to a level which is sufficient for the gate line connected to the output terminal 51 of the bistable circuit to become a selection state. At this time, the potential of the first clock signal CK changes from the low level to the high level, so that the thin film transistor T5 enters an on state. Consequently, the potential of the second node N2 is reliably maintained at the low level.

In the reset period (at the time point t2), the potential of the first clock signal CK changes from the high level to the low level. Since the thin film transistor T2 is in the on state at the time point t2, as the potential of the input terminal 43 decreases, the potential of the state signal Q decreases. Thus, the potential of the state signal Q decreases, and therefore the potential of the first node N1 also decreases via the capacitor C1. In this period, the reset signal R changes from the low level to the high level. Consequently, the thin film transistors T6 and T7 enter an on state. As a result, in the reset period, the potential of the first node N1 and the potential of the state signal Q decrease to the low level. At the time point t2, the potential of the first node N1 becomes the low level as described above, and the potential of the second clock signal CKB becomes the high level. Consequently, the potential of the second node N2 changes from the low level to the high level. Accordingly, the thin film transistor T8 enters an on state, so that the potential of the first node N1 reliably becomes the low level.

In the normal operation period (in the period before the time point t0 and the period after the time point t3 in the write period), the first node N1 is a floating state. Consequently, due to the influence of parasitic capacitance between the gate and drain of the thin film transistor T2, the potential of the first node N1 fluctuates in accordance with the potential fluctuation in the first clock signal CK. In the present embodiment, however, at this time, the potential of the second node N2 changes according to the potential fluctuation in the second clock signal CKB having the phase opposite to that of the first clock signal CK, so that the potential fluctuation in the first node N1 is suppressed. In the normal operation period, the potential of the second node N2 repeats the on level and the off level every horizontal scanning period, so that the thin film transistor T8 enters an on state every one horizontal scanning period. Consequently, the gate stress in the thin film transistor T8 is reduced more than the case where the potential of the second node N2 is always set to the high level in the normal operation period. Therefore, while suppressing the threshold shift in the thin film transistor T8, the potential of the first node can be maintained at the low level in the normal operation period.

The operation of the bistable circuit in the write period has been described above. The operation of the bistable circuit in the vertical blanking period will be described later together with the operation of the gate driver in the vertical blanking period.

<1.5 Configuration of Clock Control Circuit>

Figure 9:
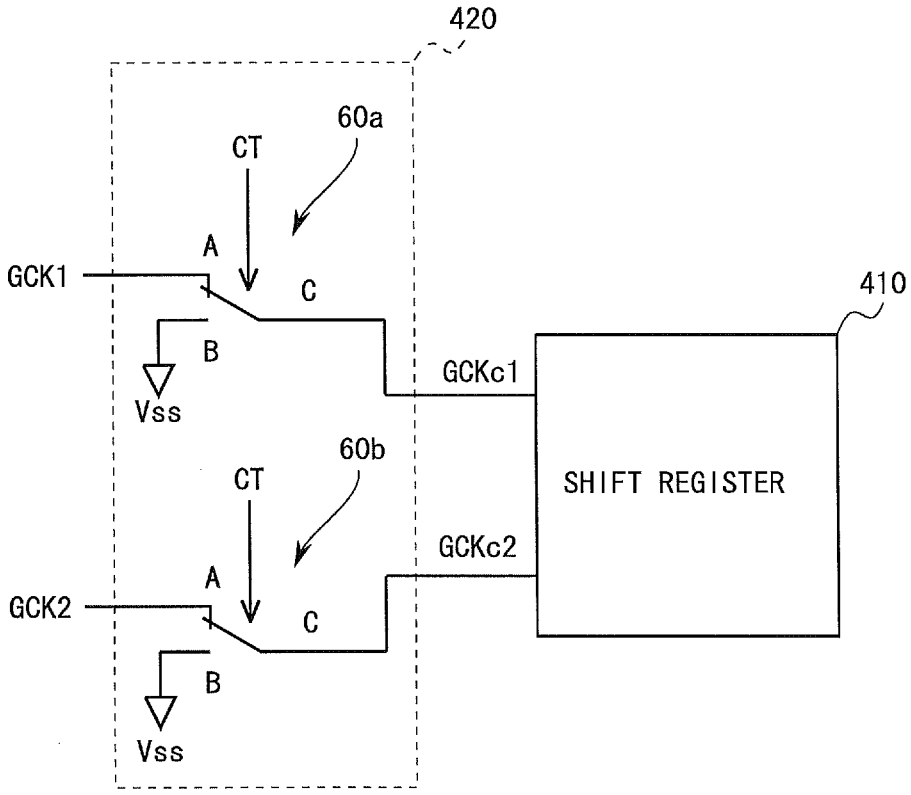
FIG. 9 is a circuit diagram for explaining the configuration of a clock control circuit in the first embodiment.

FIG. 9 is a circuit diagram for explaining the configuration of the clock control circuit 420 in the present embodiment. The clock control circuit 420 receives the first gate clock signal GCK1 and the second gate clock signal GCK2 from the display control circuit 200 and outputs the post-control first gate clock signal GCKc1 and the post-control second gate clock signal GCKc2, respectively.

As illustrated in FIG. 9, the clock control circuit 420 is configured by a first change-over switch 60*a* and a second change-over switch 60*b*. With respect to the first change-over switch 60*a*, the first gate clock signal GCK1 is supplied to a first switching terminal A, the DC power supply potential Vss is supplied to a second switching terminal B, and a common terminal C is connected to the bistable circuits in the shift register 410. With respect to the second change-over switch 60*b*, the second gate clock signal GCK2 is supplied to a first switching terminal A, the DC power supply potential Vss is supplied to a second switching terminal B, and a common terminal C is connected to the bistable circuits in the shift register 410. The switching operation of the first change-over switch 60*a* and the second change-over switch 60*b* is controlled by the control signal CT. The first change-over switch 60*a* and the second change-over switch 60*b* are controlled to select the switching terminal A when the potential of the control signal CT is at the off level and to select the switching terminal B when the potential is at the on level. With such a configuration, the first gate clock signal GCK1 and the second gate clock signal GCK2 whose potential is fixed to the Vss potential only in a control period which will be described later are supplied as the post-control first gate clock signal GCKc1 and the post-control second gate clock signal GCKc2, respectively, to the shift register 410. In other words, supply of the first gate clock signal GCK1 and the second gate clock signal GCK2 to the shift register 410 is stopped in the control period which will be described later.

<1.6 Operation of Gate Driver in Vertical Blanking Period>

Figure 10:
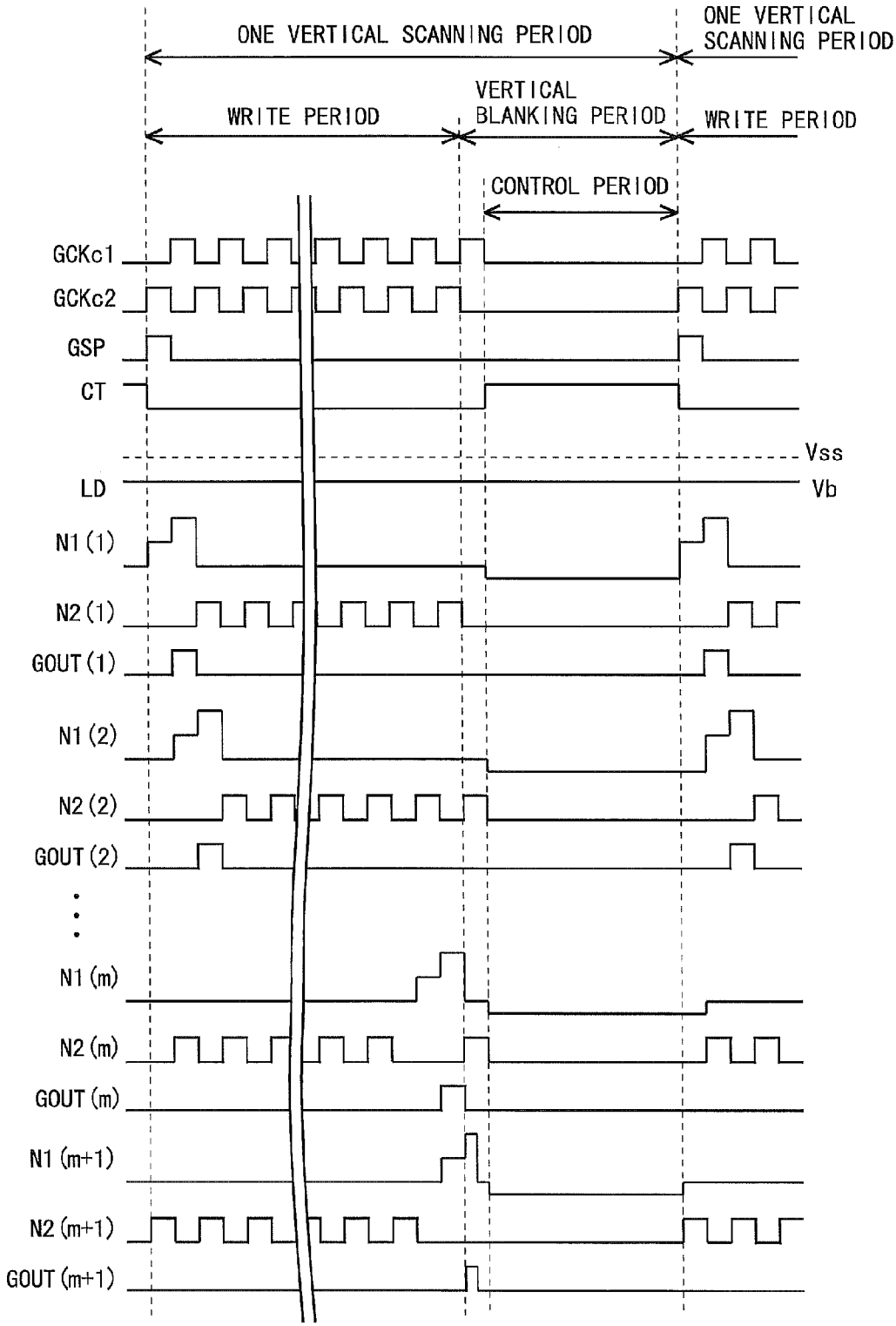
FIG. 10 is a signal waveform diagram for explaining the operation of the bistable circuit in a vertical blanking period in the first embodiment.

FIG. 10 is a signal waveform diagram for explaining the operation of the gate driver in a vertical blanking period in the present embodiment. It should be noted that, in the following, for convenience of explanation, the first nodes N1 in the first stage 40(1) to the (m+1)th stage 40(*m*+1) will be expressed by reference numerals N1(1) to N1(*m*+1), respectively, and the second nodes N2 will be expressed as reference numerals N2(1) to N2(*m*+1). The first nodes N1(1) to N1(*m*+1) will be called "first stage first node to (m+1)th stage first node", respectively, and the second nodes N2(1) to N2(*m*+1) will be called "first stage second node to (m+1)th stage second node". Although the vertical blanking period is expressed as nine horizontal scanning periods in FIG. 10, the present invention is not limited to this.

Figure 11:
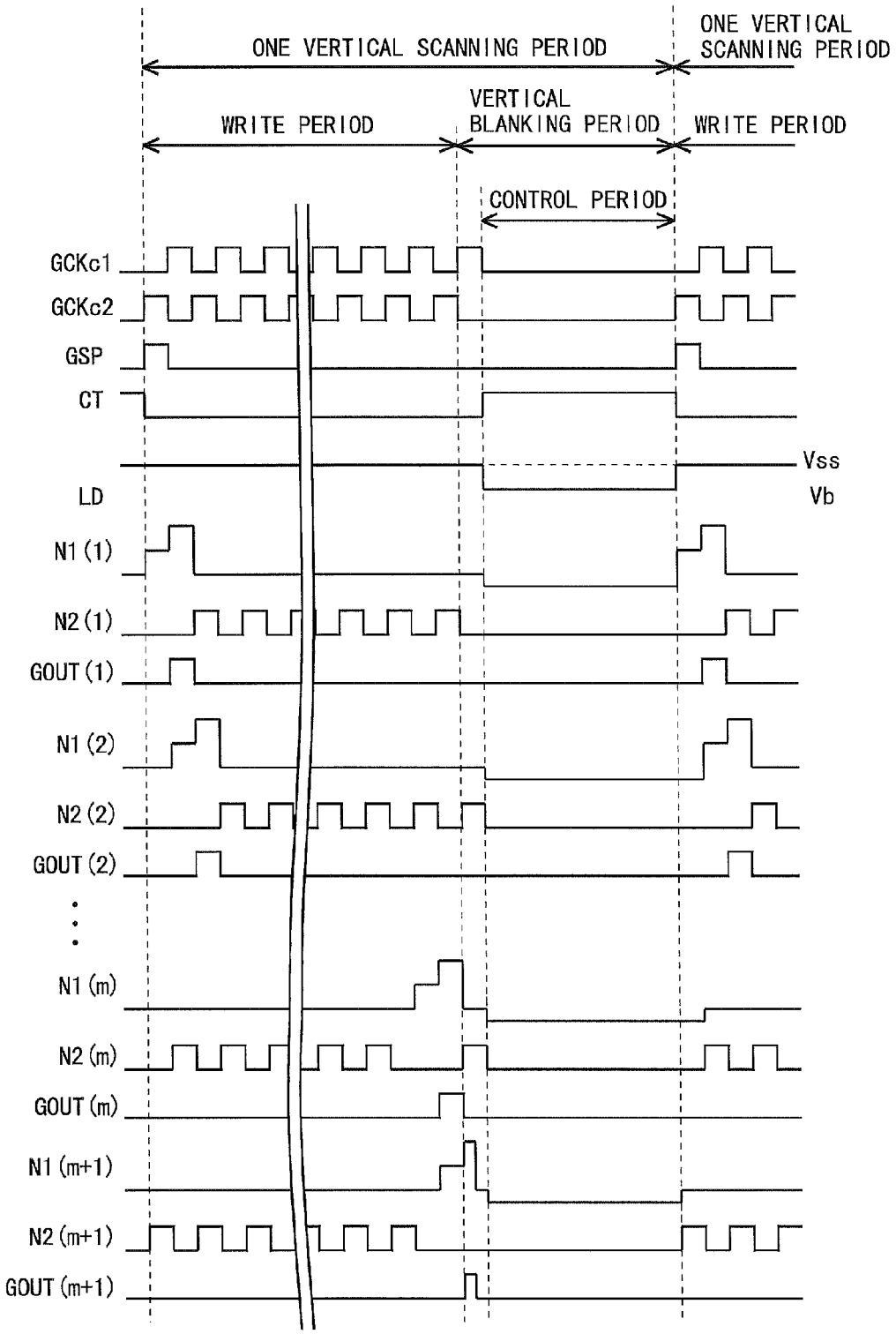
FIG. 11 is a signal waveform diagram for explaining another example of the first embodiment.

As illustrated in FIG. 10, the potential of the control signal CT which is supplied to each of the stages is always at the low level in the write period, becomes the low level only in the first one horizontal scanning period in the vertical blanking period, and becomes the high level in the remaining period. In the following, the period in which the potential of the control signal CT is at the high level (the period except for the first one horizontal scanning period in the vertical blanking period) will be called the "control period". The level down signal LD in the present embodiment has a potential Vb lower than that of the DC power supply potential Vss. The level down signal LD is generated by the DC/DC converter 110 and supplied to the gate driver 400. Although the level down signal LD is a fixed potential in the present embodiment as described above, the present invention is not limited to this. The level down signal LD may have the Vb potential at least in the control period. As illustrated in FIG. 11, the level down signal LD may have the Vb potential only in the control period and have the Vss potential in the other periods.

As illustrated in FIG. 10, in the write period, in each of the stages, the above-described operation is performed at a timing deviated from a timing of the preceding stage by one horizontal scanning period. When the scanning signal GOUT (m+1) of the dummy stage 40(*m*+1) becomes the high level, the scanning signal GOUT(m) of the m-th stage 40(*m*) becomes the low level, the write period ends, and at the same time the vertical blanking period starts. It should be noted that, since the state signal Q of the dummy stage 40(*m*+1) is supplied as the reset signal R to the dummy stage 40(*m*+1) as described above, the period in which the scanning signal GOUT(m+1) of the dummy stage 40(*m*+1) and the (m+1)th first node are at the high level is shorter than the period in any of the other stages.

At the start time point of the vertical blanking period, the potential of the first node N1 in each stage is at the low level (Vss potential). In the vertical blanking period, when the potential of the control signal CT changes from the low level to the high level (when it comes to the control period), the thin film transistor TA in each stage illustrated in FIG. 7 enters an on state. Consequently, the potential of the first node N1 changes from a Vss potential to be originally maintained to a Vb potential which is lower than the Vss potential. Since the thin film transistor T9 enters an on state at this time, the thin film transistor T8 having the source terminal to which the Vss potential is supplied enters an off state. In such a manner, the above-described operation in which the potential of the first node N1 changes to the Vb potential is reliably performed. As described above, in the control period, supply of the clock signal to the bistable circuit is stopped. More specifically, the potentials of the first clock signal CK and the second clock signal CKB received by each of the bistable circuits are at the low level (Vss potential). Consequently, the above-described operation in which the potential of the first node N1 changes to the Vb potential is more reliably performed. By the operation as described above, in the present embodiment, the potential of the first node N1 becomes the Vb potential which is lower than the Vss potential in the control period.

When the vertical blanking period is finished, the control signal CT changes from the high level to the low level, so that the thin film transistors TA and T9 enter an off state. Moreover, the supply of the first gate clock signal GCK1 and the second gate clock signal GCK2 to the shift register 410 is restarted. With respect to the first stage 40(1), the potential of the set signal becomes the high level at start time point of the vertical scanning period, so that the potential of the first node N1 changes toward the high level. With respect to the second stage 40(2), the potential of the set signal becomes the high level after one horizontal scanning period since start time point of the vertical scanning period, so that the potential of the first node N1 changes toward the high level. With respect to odd-numbered stages other than the first stage 40(1), the potential of the second clock signal CKB becomes the high level at start time point of the vertical scanning period. Consequently, by the thin film transistor T8 entering an on state, the potential of the first node N1 changes toward the Vss potential. With respect to even-numbered stages other than the second stage, the second clock signal CKB becomes the high level after one horizontal scanning period since start time point of the vertical scanning period. Consequently, by the thin film transistor T8 entering an on state, the potential of the first node N1 changes toward the Vss potential.

<1.7 Effect>

According to the present embodiment, in the control period included in the vertical blanking period, the thin film transistor T2 is driven by the gate voltage which is lower than that in the conventional technique. Consequently, the gate stress in the thin film transistor T2 is reduced as compared with that in the conventional technique. Therefore, since the threshold shift in the thin film transistor T2 for controlling output is suppressed, dullness of the scanning signal can be suppressed. By suppressing dullness of the scanning signal as described above, display quality in the liquid crystal display device improves.

It should be noted that, in the above-described example, the thin film transistor T9 for changing the potential of the second node N2 toward the Vss potential in the control period is provided for each stage. The thin film transistors T9 may be provided for only the even-numbered stages in which the potential of the second node N2 is at the high level at the start time point of the control period.

The configuration may be such that the thin film transistor T9 is not provided for each stage. In this case, desirably, supply of the first gate clock signal GCK to the shift register 410 is stopped at the start time of the vertical blanking period. Not necessarily by such a mode, the thin film transistor T2 can be driven by the gate voltage which is lower than that in the conventional technique in the control period.

Although the supply of the first gate clock signal GCK1 and the second gate clock signal GCK2 to the shift register 410 is stopped in the control period in the above-described example, the present invention is not limited to this. Also with the mode that the supply of the first gate clock signal GCK1 and the second gate clock signal GCK2 to the shift register 410 is not stopped in the control period, the thin film transistor T2 can be driven by the gate voltage which is lower than that in the conventional technique in the control period.

Figure 12:
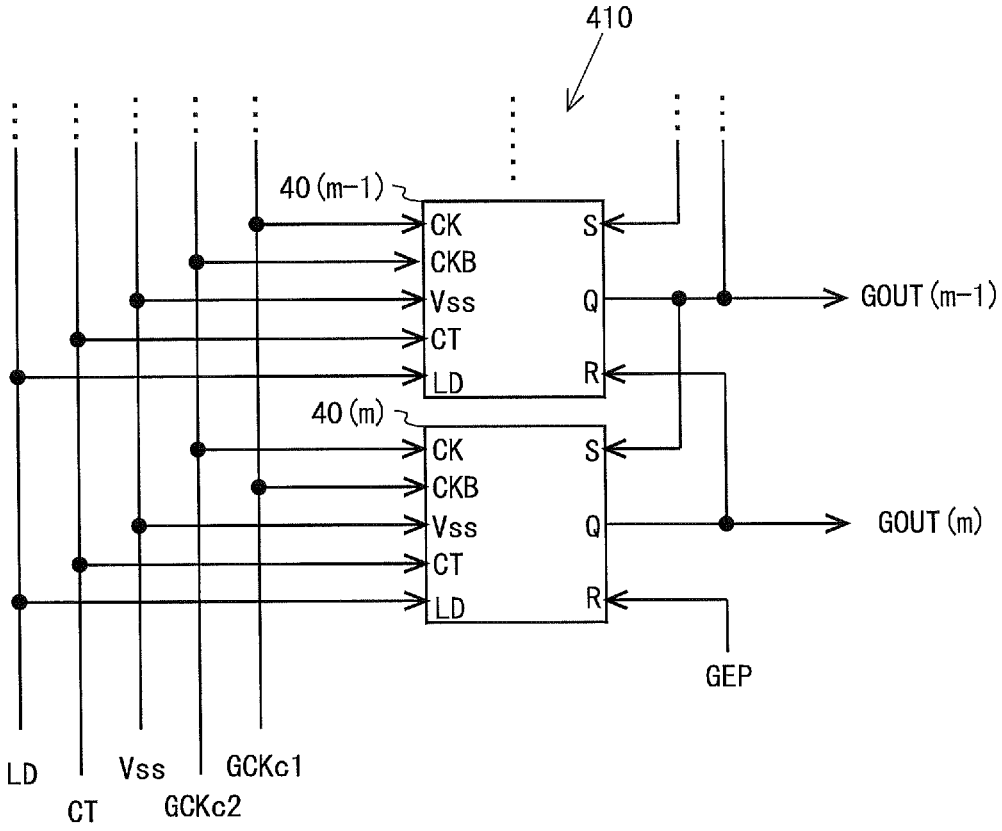
FIG. 12 is a block diagram illustrating the configuration of a last stage side of the shift register in another example of the first embodiment.

In the above-described example, the dummy stage 40(*m*+1) is provided in a post stage of the m-th stage (last stage) 40(*m*) of the shift register 410. Alternatively, the configuration may be such that a gate end pulse signal GEP is applied to the reset terminal of the m-th stage (last stage) 40(*m*) as illustrated in FIG. 12. The gate end pulse signal GEP is a signal which changes from the low level to the high level after the scanning signal GOUT(m) in the m-th stage changes from the high level to the low level, maintains the high level for one horizontal scanning period and, after that, changes to the low level. In this case, the circuit area of the gate driver 400 is reduced, so that the picture-frame area of the liquid crystal display device can be reduced.

2. Second Embodiment

<2.1 Configuration of Bistable Circuit>

Figure 13:
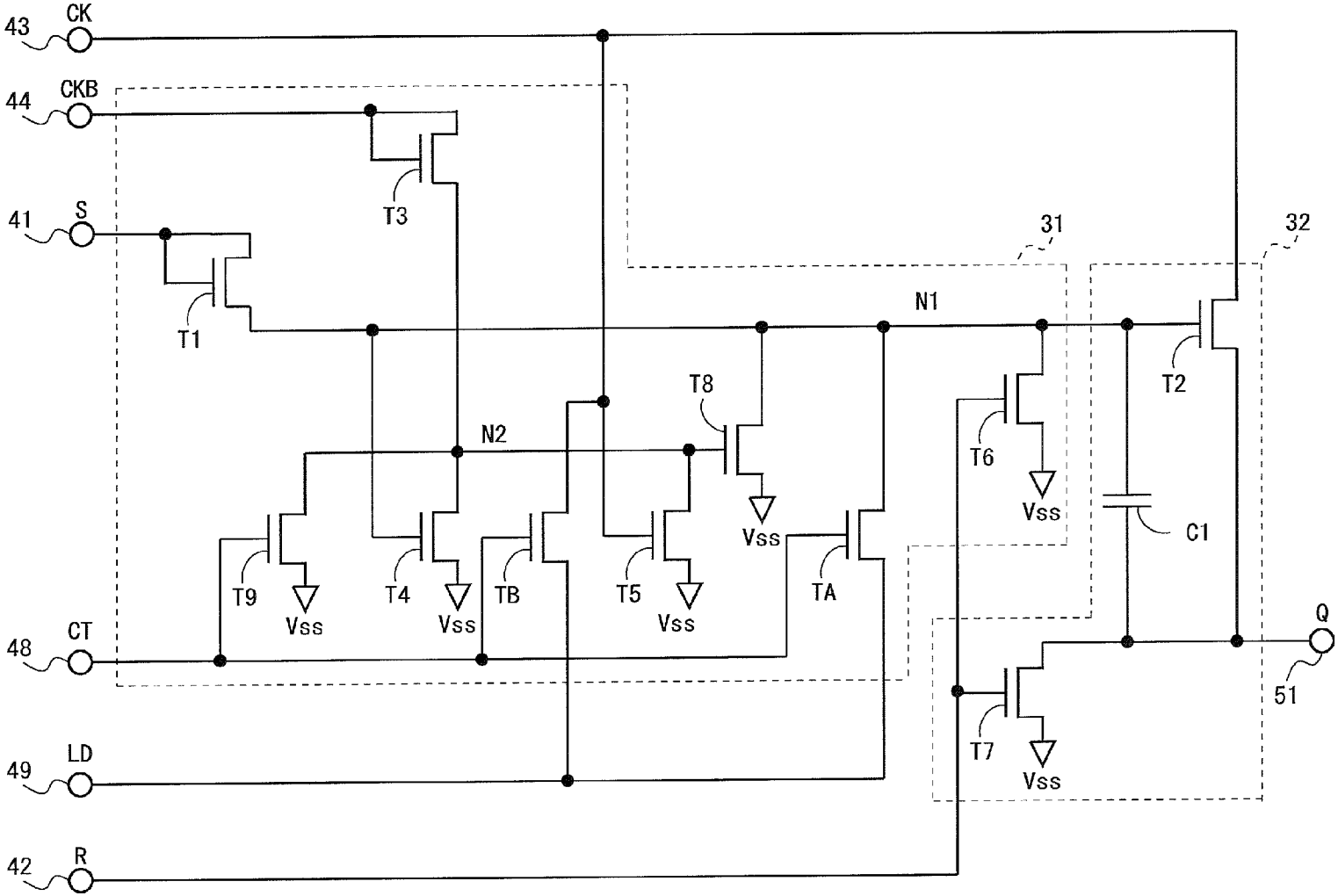
FIG. 13 is a circuit diagram illustrating a configuration of a bistable circuit in a second embodiment of the present invention.

FIG. 13 is a circuit diagram for explaining the configuration of a bistable circuit in a second embodiment of the present invention. Since the general configuration and operation of the liquid crystal display device and the configuration and operation in a write period of the gate driver 400 in the present embodiment are similar to those in the first embodiment, their description is omitted. As illustrated in FIG. 13, a thin film transistor TB is further provided in the bistable circuit in the present embodiment. It should be noted that, since the other configuration is similar to that of the foregoing first embodiment, the description thereof is omitted.

With respect to the thin film transistor TB, the gate terminal is connected to the input terminal 48, the drain terminal is connected to the gate terminal (input terminal 43) of the thin film transistor T5, and the source terminal is connected to the input terminal 49. When the potential of the control signal CT is at the high level, the thin film transistor TB changes the potential of the gate terminal (input terminal 43) of the thin film transistor T5 toward the Vb potential which is lower than the Vss potential. In the present embodiment, the first clock level down switching element is realized by the thin film transistor TB.

<2.2 Operation of Gate Driver in Vertical Blanking Period>

When the control signal CT changes from the low level to the high level in the vertical blanking period (when it comes to the control period), the thin film transistor TB illustrated in FIG. 13 enters an on state, and the potentials of the first clock signal CK and the second clock signal CKB received by each of the bistable circuits become the low level (Vss potential). A level down signal LD is applied to the source terminal of the thin film transistor TB. Consequently, the potential supplied to the gate terminal of the thin film transistor T5 in each stage changes from the Vss potential to be originally maintained toward the Vb potential which is lower than the Vss potential. As described above, in the present embodiment, the potential supplied to the gate terminal of the thin film transistor T5 becomes a potential which is lower than the Vss potential in the control period.

When the vertical blanking period is finished, the control signal CT changes from the high level to the low level, so that the thin film transistor TB enters an off state. Supply of the first gate clock signal GCK1 and the second gate clock signal GCK2 to the shift register 410 is restarted. At this time, with respect to the odd-numbered stages, the potential of the first clock signal CK becomes the low level (Vss potential), so that the potential of the input terminal 43 becomes the low level (Vss potential). On the other hand, with respect to the even-numbered stages, the potential of the first clock signal CK becomes the high level (Vdd potential), so that the potential of the input terminal 43 becomes the high level (Vdd potential).

<2.3 Effects>

According to the present embodiment, in the control period included in the vertical blanking period, the thin film transistor T5 whose gate terminal is connected to the input terminal 43 is driven by gate voltage which is lower than that in the conventional technique. Consequently, the gate stress in the thin film transistor T5 is reduced as compared with that in the conventional technique. Accordingly, the threshold shift in the thin film transistor T5 is suppressed, so that the thin film transistor T8 for controlling the potential of the first node N1 is controlled more accurately. Therefore, stabilization of the circuit operation (particularly, the potential of the first node N1 in the normal operation period) can be achieved.

Also in the present embodiment, the thin film transistor T2 is driven by the gate voltage which is lower than that in the conventional technique. In the above-described example, in a manner similar to the first embodiment, supply of the first gate clock signal GCK1 and the second gate clock signal GCK2 to the shift register 410 is stopped in the control period. Also in the mode in which the supply of the first gate clock signal GCK1 and the second gate clock signal GCK2 to the shift register 410 is not stopped in the control period, the thin film transistor T5 can be driven by the gate voltage which is lower than that in the conventional technique in the control period.

<2.4 Modification>

Figure 14:
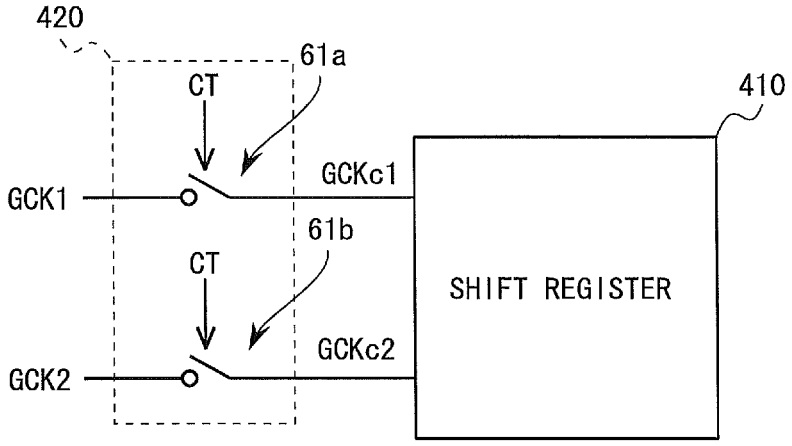
FIG. 14 is a circuit diagram for explaining a configuration of a clock control circuit in a modification of the second embodiment.

FIG. 14 is a circuit diagram for explaining the configuration of the clock control circuit 420 in a modification of the second embodiment. Different from the first embodiment, the clock control circuit 420 in the present modification is configured by a first open/close switch 61*a* and a second open/close switch 61*b*. To one end of the first open/close switch 61*a*, the first gate clock signal GCK1 is supplied. The other end of the first open/close switch 61*a* is connected to each of the bistable circuits in the shift register 410. To one end of the second open/close switch 61*b*, the second gate clock signal GCK2 is supplied. The other end of the second open/close switch 61*b* is connected to each of the bistable circuits in the shift register 410. The opening/closing operation of the first open/close switch 61*a* and the second open/close switch 61*b* is controlled by the control signal CT. The first open/close switch 61*a* and the second open/close switch 61*b* are controlled so as to be closed when the potential of the control signal CT is at the off level and to be opened when the potential of it is at the on level.

With the configuration as described above, only in the control period, the supply of the first gate clock signal GCK1 and the second gate clock signal GCK2 to the shift register 410 is stopped and the input terminals 43 and 44 in each bistable circuit are opened (enter a high-impedance state). Consequently, in the control period, the potential applied to the gate terminal of the thin film transistor T5 in each stage reliably changes from the Vss potential to be originally maintained to the Vb potential which is lower than the Vss potential. Accordingly, in the control period included in the vertical blanking period, the thin film transistor T5 whose gate terminal is connected to the input terminal 43 is more reliably driven by the gate voltage which is lower than that in the conventional technique. Therefore, the gate stress of the thin film transistor T5 is more reliably reduced as compared with that in the conventional technique. Accordingly, the threshold shift in the thin film transistor T5 is more reliably suppressed. Moreover, in the present modification, the power consumption can be reduced as compared with that in the second embodiment.

3. Third Embodiment

<3.1 Configuration of Bistable Circuit>

Figure 15:
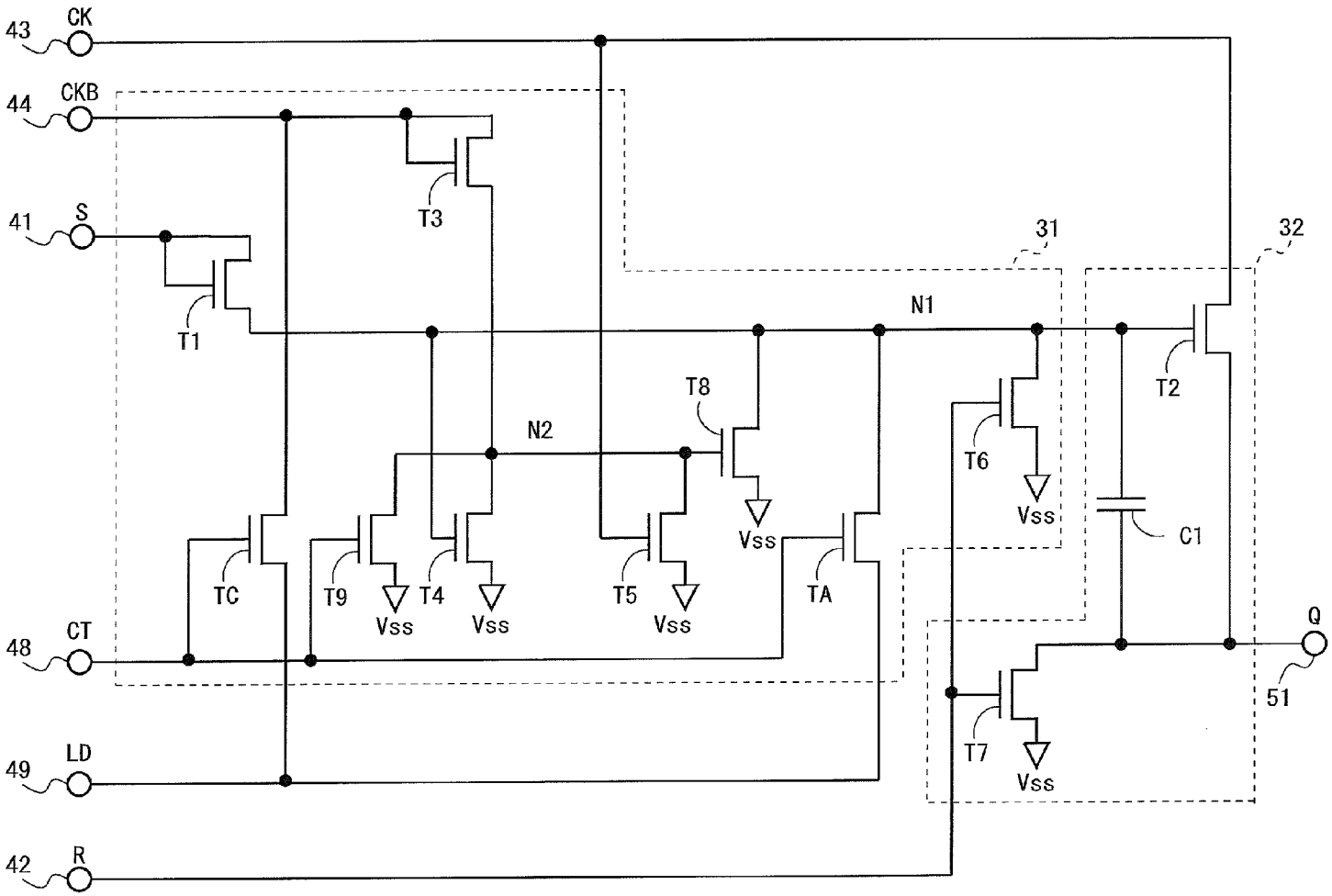
FIG. 15 is a circuit diagram illustrating a configuration of a bistable circuit in the third embodiment.
Figure 16:
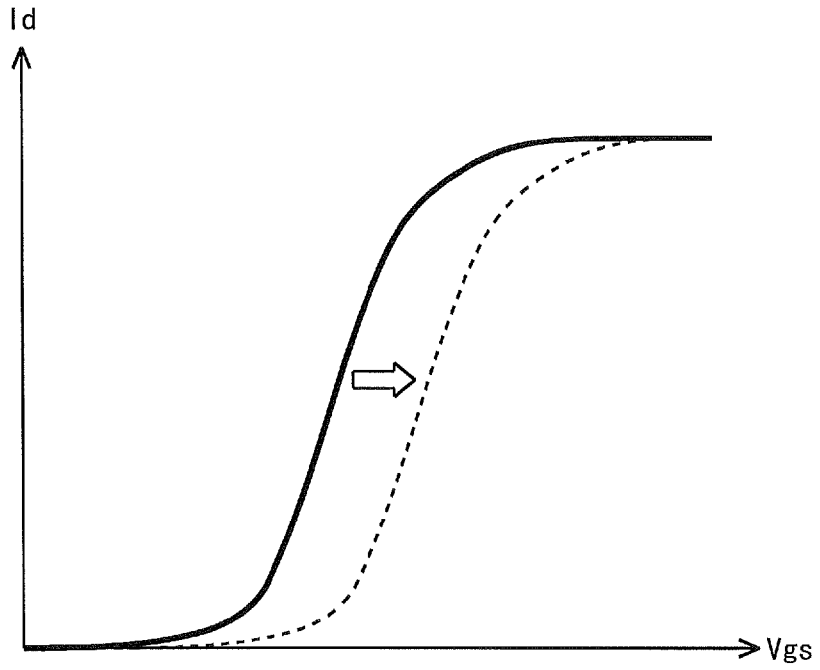
FIG. 16 is a drain current versus gate-to-source voltage characteristic diagram for explaining a state where threshold shift occurs in a transistor.
Figure 17:
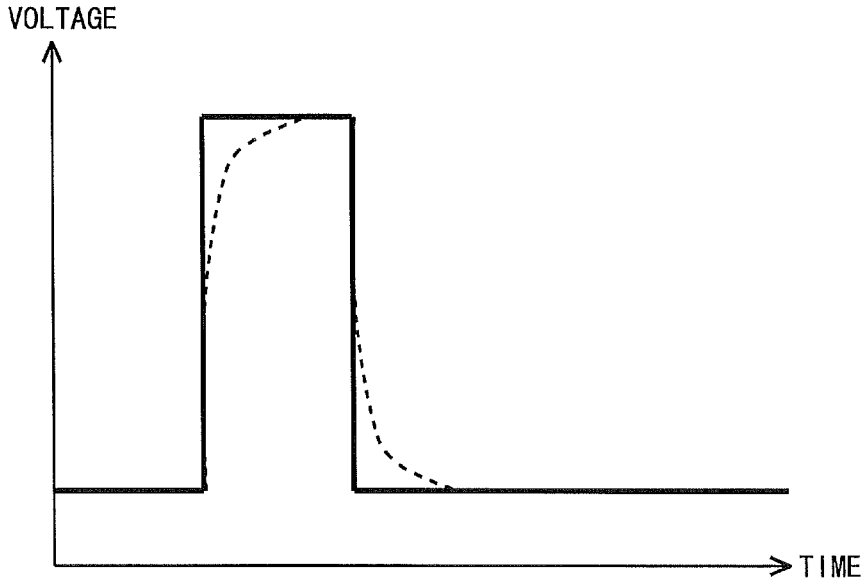
FIG. 17 is a signal waveform diagram for explaining a state where an output signal becomes dull due to the threshold shift.
Figure 18:
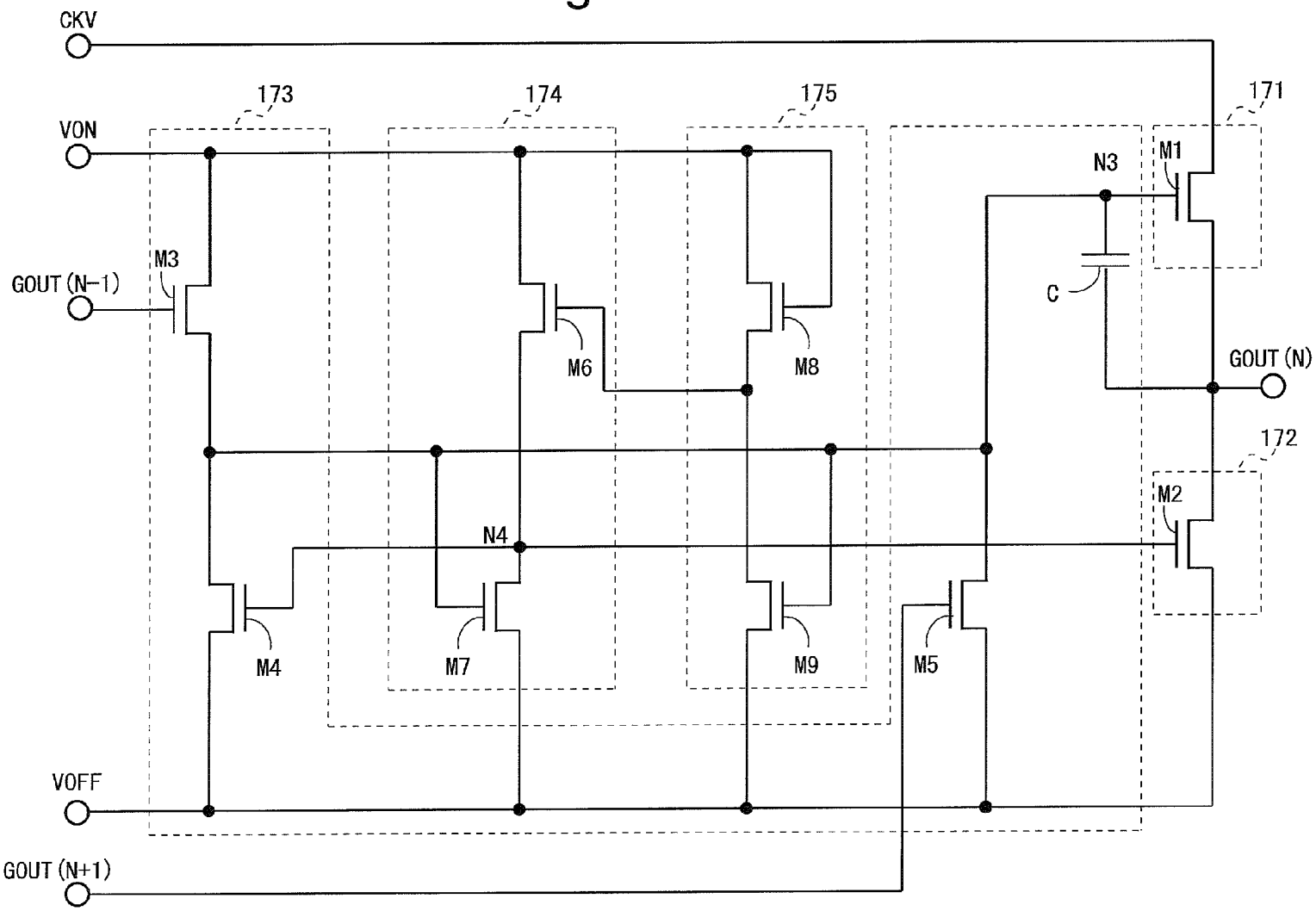
FIG. 18 is a circuit diagram illustrating a configuration of a conventional bistable circuit.

FIG. 15 is a circuit diagram for explaining the configuration of a bistable circuit in the third embodiment of the present invention. Since the general configuration and operation of the liquid crystal display device and the configuration and operation in a write period of the gate driver 400 in the present embodiment are similar to those in the first embodiment, their description are omitted. As illustrated in FIG. 15, a thin film transistor TC is further provided in the bistable circuit in the present embodiment.

With respect to the thin film transistor TC, the gate terminal is connected to the input terminal 48, the drain terminal is connected to the gate terminal and the drain terminal (input terminal 44) of the thin film transistor T3, and the source terminal is connected to the input terminal 49. When the potential of the control signal CT is at the high level, the thin film transistor TC changes the potential of the gate terminal and the drain terminal (input terminal 44) of the thin film transistor T3 toward the Vb potential to be described later, which is lower than the Vss potential. In the present embodiment, the second clock level down switching element is realized by the thin film transistor TC.

<3.2 Operation of Gate Driver in Vertical Blanking Period>

When the control signal CT changes from the low level to the high level in the vertical blanking period (when it comes to the control period), the thin film transistor TC illustrated in FIG. 15 enters an on state, and the input terminal 44 is opened as described above. The level down signal LD is applied to the source terminal of the thin film transistor TC. Consequently, the potential supplied to the gate terminal of the thin film transistor T3 in each stage changes from the Vss potential to be originally maintained toward the Vb potential which is lower than the Vss potential. As described above, in the present embodiment, in the control period, the potential supplied to the gate terminal of the thin film transistor T3 becomes a potential which is lower than the Vss potential.

When the vertical blanking period is finished, the control signal CT changes from the high level to the low level, so that the thin film transistor TC enters an off state. Supply of the first gate clock signal GCK1 and the second gate clock signal GCK2 to the shift register 410 is restarted. At this time, with respect to the odd-numbered stages, the potential of the second clock signal CKB becomes the high level (Vdd potential), so that the potential of the input terminal 44 becomes the high level (Vdd potential). On the other hand, with respect to the even-numbered stages, the potential of the second clock signal CKB becomes the low level (Vss potential), so that the potential of the input terminal 44 becomes the low level (Vss potential).

<3.3 Effects>

As described above, in the present embodiment, in the control period included in the vertical blanking period, the thin film transistor T3 whose gate terminal is connected to the input terminal 44 is driven by gate voltage which is lower than that in the conventional technique. Consequently, the gate stress in the thin film transistor T3 is reduced as compared with that in the conventional technique. Accordingly, the threshold shift in the thin film transistor T3 is suppressed, so that the thin film transistor T8 for controlling the potential of the first node N1 is controlled more accurately. Therefore, stabilization of the circuit operation (particularly, the potential of the first node N1 in the normal operation period) can be achieved.

It should be noted that, also in the present embodiment, the clock control circuit 420 in the modification of the second embodiment may be used. In this case, in the control period included in the vertical blanking period, the thin film transistor T3 whose gate terminal is connected to the input terminal 44 is more reliably driven by the gate voltage which is lower than that in the conventional technique. Therefore, the gate stress of the thin film transistor T3 is more reliably reduced as compared with that in the conventional technique, so that the threshold shift in the thin film transistor T3 can be more reliably suppressed. In this case, the power consumption can be further reduced.

In the above example, in a manner similar to the first and second embodiments, supply of the first gate clock signal GCK1 and the second gate clock signal GCK2 to the shift register 410 is stopped in the control period. Also in the mode in which the supply of the first gate clock signal GCK1 and the second gate clock signal GCK2 to the shift register 410 is not stopped in the control period, the thin film transistor T3 can be driven by the gate voltage which is lower than that in the conventional technique in the control period.

<4. Others>

Although the period after the first one horizontal scanning period in the vertical blanking period is set as the control period in each of the foregoing embodiments, the present invention is not limited to this. The control period may be set shorter than the period after the first one horizontal scanning period in the vertical blanking period. The control period may be finished at a time point earlier than the end time point of the vertical blanking period. Note that the longer the control period is, the period of driving the thin film transistors T2, T3, and T5 by the gate voltage which is lower than that in the conventional technique becomes longer, so that the effect of the present invention can be sufficiently obtained. For example, in the first embodiment, in the case where the thin film transistor TA is not provided only for the dummy stage 40($m$+1) or in the case where the dummy stage 40($m$+1) is not provided and the gate end pulse signal GEP is supplied to the reset terminal of the m-th stage (last stage) 40($m$), the first one horizontal scanning period in the vertical blanking period may be included in the control period.

The configuration of the bistable circuit in the present invention is not limited to that of each of the foregoing embodiments. Change of connection among the elements and various changes such as addition/deletion of the elements are possible. In each of the foregoing embodiments, the configuration is such that the two-phase clock signals are supplied to each of the bistable circuits. However, the present invention is not limited to this. For example, the configuration may be such that clock signals such as 4-phase clock signals, 8-phase clock signals, 16-phase clock signals, or the like are supplied to each of the bistable circuits. For example, the configuration may be such that only one-phase clock signal is supplied to each of the bistable circuits (note that the phases are different from each other in neighboring bistable circuits).

Although one clock control circuit 420 is provided in the gate driver 400 in each of the foregoing embodiments, the present invention is not limited to this. For example, a circuit corresponding to the clock control circuit 420 may be provided in each of the bistable circuits. Although the supply of the first gate clock signal GCK1 and the second gate clock signal GCK2 to the shift register 410 is controlled by the clock control circuit 420 in each of the foregoing embodiments, the present invention is not limited to this. For example, the configuration may be such that the supply of the first gate clock signal GCK1 and the second gate clock signal GCK2 to the shift register 410 is controlled in the display control circuit 200 without providing the clock control circuit 420 in the gate driver 400.

Although the liquid crystal display device has been described in each of the foregoing embodiments, the present invention is not limited to this. The present invention can be applied to other display devices such as an organic EL (Electro Luminescence) display device. Moreover, the foregoing embodiments can be variously modified and executed without departing from the gist of the present invention.

From the above, according to the present invention, the scanning signal line drive circuit which suppresses dullness of a scanning signal, the display device having the same, and the drive method for a scanning signal line for suppressing dullness of a scanning signal can be provided.

INDUSTRIAL APPLICABILITY

The present invention can be applied to a scanning signal line drive circuit, a display device having the same, and a drive method for a scanning signal line by the scanning signal line drive circuit and, particularly, is suitable to a scanning signal line drive circuit which is monolithically fabricated, a display device having the same, and a drive method for a scanning signal line by the scanning signal line drive circuit.

DESCRIPTION OF REFERENCE CHARACTERS

31: DRIVE UNIT
32: OUTPUT UNIT
40(1) to 40($m$): BISTABLE CIRCUIT
40($m$+1): DUMMY BISTABLE CIRCUIT
41 to 44, 48, 49: INPUT TERMINAL
51: OUTPUT TERMINAL (OUTPUT NODE)
60$a$, 60$b$: FIRST CHANGE-OVER SWITCH, SECOND CHANGE-OVER SWITCH
61$a$, 61$b$: FIRST OPEN/CLOSE SWITCH, SECOND OPEN/CLOSE SWITCH
300: SOURCE DRIVER (VIDEO SIGNAL LINE DRIVE CIRCUIT)
400: GATE DRIVER (SCANNING SIGNAL LINE DRIVE CIRCUIT)
410: SHIFT REGISTER
420: CLOCK CONTROL CIRCUIT
600: DISPLAY UNIT
C1: CAPACITOR (CAPACITIVE ELEMENT)
T1 to T9, TA to TC: THIN FILM TRANSISTOR (SWITCHING ELEMENT)
N1: FIRST NODE
N2: SECOND NODE
GCK1, GCK2: FIRST GATE CLOCK SIGNAL, SECOND GATE CLOCK SIGNAL
GCKc1, GCKc2: POST-CONTROL FIRST GATE CLOCK SIGNAL, POST-CONTROL SECOND GATE CLOCK SIGNAL
GSP: GATE START PULSE SIGNAL (START PULSE SIGNAL)
CT: CONTROL SIGNAL
LD: LEVEL DOWN SIGNAL
GEP: GATE END PULSE SIGNAL
CK: FIRST CLOCK SIGNAL
CKB: SECOND CLOCK SIGNAL
S: SET SIGNAL
R RESET SIGNAL
GOUT(1) to GOUT(m): SCANNING SIGNAL
Vss: LOW-LEVEL DC POWER SUPPLY POTENTIAL

The invention claimed is:

1. A scanning signal line drive circuit for periodically driving a plurality of scanning signal lines, the scanning signal line drive circuit comprising:

a shift register including a plurality of bistable circuits which are cascade-connected to one another and sequentially making output signals of the plurality of bistable circuits active based on clock signals which are supplied from the outside and periodically repeats an on level and an off level, wherein each of the bistable circuits comprises:

a drive unit having a first node and changing a potential of the first node based on a set signal; and an output unit connected to the first node and, when the potential of the first node is at the on level, outputting one of the output signals which is active based on the clock signals, the set signal in the bistable circuit in a front stage is a start pulse signal which becomes an on level at a scanning start timing, the set signal in the bistable circuit in a stage other than the front stage is an output signal of the bistable circuit of a preceding stage, the output unit has an output control switching element having a control terminal connected to the first node, a conduction terminal to which one of the clock signals is supplied, and another conduction terminal connected to an output node for outputting one of the output signals, and the drive unit has a first node level down switching element having a control terminal to which a control signal whose potential becomes the on level in a control period as a predetermined period in a vertical blanking period in which all of the output signals of the plurality of bistable circuits are inactive is supplied, a conduction terminal connected to the first node, and another conduction terminal to which a level down signal which becomes a level down potential as a potential lower than the off level at least in the control period is supplied.

2. The scanning signal line drive circuit according to claim 1, wherein the clock signals include a first clock signal and a second clock signal whose phases are deviated from each other only by one horizontal scanning period, the first clock signal is supplied to the conduction terminal of the output control switching element, and the drive unit further comprises:

a second node;

a second-node-on-time first node turn off switching element having a control terminal connected to the second node, a conduction terminal connected to the first node, and another conduction terminal to which a potential at the off level is supplied;

a second node variation switching element for changing a potential of the second node based on the second clock signal; and a first-clock-signal-on-time second node turn off switching element having a control terminal to which the first clock signal is supplied, a conduction terminal connected to the second node, and another conduction terminal to which a potential at the off level is supplied.

3. The scanning signal line drive circuit according to claim 2, wherein supply of the first clock signal and the second clock signal to the plurality of bistable circuits is stopped in the control period.

4. The scanning signal line drive circuit according to claim 3, wherein the drive unit further comprises a control period second node turn off switching element having a control terminal to which the control signal is supplied, a conduction terminal connected to the second node, and another conduction terminal to which a potential at the off level is supplied.

5. The scanning signal line drive circuit according to claim 2, wherein the drive unit further comprises a first clock level down switching element having a control terminal to which the control signal is supplied, a conduction terminal connected to the control terminal of the first-clock-signal-on-time second node turn off switching element, and another conduction terminal to which the level down signal is supplied.

6. The scanning signal line drive circuit according to claim 5, wherein in the control period, supply of the first clock signal to the plurality of bistable circuits is stopped, and a terminal of each bistable circuit for receiving the first clock signal enters a high impedance state.

7. The scanning signal line drive circuit according to claim 2, wherein the drive unit further comprises a second clock level down switching element having a control terminal to which the control signal is supplied, a conduction terminal connected to the control terminal and the conduction terminal of the second node variation switching element, and another conduction terminal to which the level down signal is supplied.

8. The scanning signal line drive circuit according to claim 7, wherein in the control period, supply of the second clock signal to the plurality of bistable circuits is stopped, and a terminal of each bistable circuit for receiving the second clock signal enters a high impedance state.

9. The scanning signal line drive circuit according to claim 1, wherein the drive unit further comprises a first node turn on switching element which changes the potential of the first node toward the on level based on the set signal.

10. The scanning signal line drive circuit according to claim 1, wherein the drive unit further comprises a set-time second node turn off switching element having a control terminal connected to the first node, a conduction terminal connected to the second node, and another conduction terminal to which a potential at the off level is supplied.

11. The scanning signal line drive circuit according to claim 1, wherein the output unit further comprises a capacitive element having one end connected to the control terminal of the output control switching element and another end connected to the output node.

12. The scanning signal line drive circuit according to claim 1, wherein the drive unit further comprises a reset-time first node turn off switching element having a control terminal to which a reset signal as an output signal of the bistable circuit at a post stage of the bistable circuit having the drive unit is supplied, a conduction terminal connected to the first node, and another conduction terminal to which a potential at the off level is supplied, and the output unit further comprises an output node turn off switching element having a control terminal to which the reset signal is supplied, a conduction terminal connected to the output node, and another conduction terminal to which a potential at the off level is supplied.

13. A display device comprising:

a display unit in which a plurality of scanning signal lines are arranged;

a scanning signal line drive circuit for periodically driving the plurality of scanning signal lines; and a display control circuit supplying clock signals which periodically repeat an on level and an off level, to the scanning signal line drive circuit, wherein the scanning signal line drive circuit includes a shift register having a plurality of bistable circuits which are cascade-connected to one another and sequentially making output signals of the plurality of bistable circuits active based on the clock signals, each of the bistable circuits comprises:

a drive unit having a first node and changing a potential of the first node based on a set signal; and an output unit connected to the first node and, when the potential of the first node is at the on level, outputting one of the output signals which is active based on the clock signals, the set signal in the bistable circuit in a front stage is a start pulse signal which becomes an on level at a start timing of each of vertical scanning periods, the set signal in the bistable circuit in a stage other than the front stage is an output signal of the bistable circuit of a preceding stage, the output unit has an output control switching element having a control terminal connected to the first node, a conduction terminal to which one of the clock signals is supplied, and another conduction terminal connected to an output node for outputting one of the output signals, and the drive unit has a first node level down switching element having a control terminal to which a control signal whose potential becomes the on level in a control period as a predetermined period in a vertical blanking period in which all of the output signals of the plurality of bistable circuits are inactive is supplied, a conduction terminal connected to the first node, and another conduction terminal to which a level down signal which becomes a level down potential as a potential lower than the off level at least in the control period is supplied.

14. The display device according to claim 13, wherein the display unit and the scanning signal line drive circuit are integrally formed.

15. A drive method for a plurality of scanning signal lines by a scanning signal line drive circuit comprising a shift register including a plurality of bistable circuits which are cascade-connected to one another and sequentially making output signals of the plurality of bistable circuits active based on clock signals which are supplied from the outside and periodically repeat an on level and an off level, the drive method comprising the steps of:

changing a potential of a first node of each bistable circuit based on a set signal received by each bistable circuit; and outputting one of the output signals which is active based on one of the clock signals when the potential of the first node is at the on level, wherein each bistable circuit has an output control switching element having a control terminal connected to the first node, a conduction terminal to which one of the clock signals is supplied, and another conduction terminal connected to an output node for outputting one of the output signals, the set signal received by the bistable circuit in a front stage is a start pulse signal which becomes an on level at a scanning start timing, the set signal received by the bistable circuit in a stage other than the front stage is an output signal of the bistable circuit of a preceding stage, and the step of changing the potential of the first node includes a step of setting the potential of the first node to a level down potential as a potential which is lower than the off level at least in a control period as a predetermined period in a vertical blanking period in which all of the output signals of the plurality of bistable circuits are inactive.

* * * * *